US006202752B1

(12) United States Patent
Kuck et al.

(10) Patent No.: US 6,202,752 B1
(45) Date of Patent: Mar. 20, 2001

(54) WELLBORE MILLING METHODS

(75) Inventors: Marc David Kuck; Thomas Floyd Bailey, both of Houston; Monte Ira Johnson, The Woodlands; Robert Eugene Robertson, Tomball; Andrew Arthur Barry, Missouri City; Thurman Beamer Carter; William Allen Blizzard, Jr., both of Houston, all of TX (US); Teme Forrest Singleton, Houma, LA (US); John Douglas Roberts, Spring, TX (US); William Alan Spielman, The Woodlands, TX (US); David Michael Haugen, League City, TX (US); Guy LaMonte McClung, III, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/252,504

(22) Filed: Feb. 18, 1999

Related U.S. Application Data

(63) Continuation-in-part of application No. 09/053,254, filed on Apr. 1, 1998, now Pat. No. 6,070,665, which is a continuation-in-part of application No. 08/642,118, filed on May 2, 1996, now Pat. No. 5,806,595, and a continuation-in-part of application No. 08/962,162, filed on Oct. 31, 1997, now Pat. No. 6,024,168, which is a continuation-in-part of application No. 08/752,359, filed on Nov. 19, 1996, now Pat. No. 5,787,978, and a continuation-in-part of application No. 08/590,747, filed on Jan. 24, 1996, now Pat. No. 5,727,629, said application No. 08/590,747, and a continuation-in-part of application No. 08/414,201, filed on Mar. 31, 1995, now Pat. No. 5,531,271, and a continuation-in-part of application No. 08/300,917, filed on Sep. 6, 1994, now Pat. No. 5,425,417, and a continuation-in-part of application No. 08/225,384, filed on Apr. 4, 1994, now Pat. No. 5,409,060, and a continuation-in-part of application No. 08/119,813, filed on Sep. 10, 1993, now Pat. No. 5,452,759, and a continuation-in-part of application No. 08/210,697, filed on Mar. 18, 1994, now Pat. No. 5,429,187, said application No. 08/752,359, is a continuation-in-part of application No. 08/655,087, filed on Jun. 3, 1996, now Pat. No. 5,620,051, and a continuation-in-part of application No. 08/414,338, filed on Mar. 31, 1995, now Pat. No. 5,522,461, and a continuation-in-part of application No. 08/542,439, filed on Oct. 12, 1995, now Pat. No. 5,720,349.

(51) Int. Cl.[7] ..... E21B 7/04

(52) U.S. Cl. ..... 166/298; 175/325.2

(58) Field of Search ..... 166/298, 55.1, 166/55.6, 55.7, 50, 313; 175/325.2, 79, 80, 81, 82

(56) References Cited

U.S. PATENT DOCUMENTS

| | | | | |
|---|---|---|---|---|
| 2,014,805 | * | 9/1935 | Hinderliter | 166/55.7 |
| 2,103,622 | | 12/1937 | Kinzbach . | |
| 2,362,529 | | 11/1944 | Barrett et al. . | |

(List continued on next page.)

OTHER PUBLICATIONS

Ramos, Jr. et al.; "Horizontal Slim–Hole Drilling With Coiled Tubing: An Operator's Experience"; Society of Petroleum Engineers; pp. 152–158, 1992.*

(List continued on next page.)

*Primary Examiner*—Hoang Dang
(74) *Attorney, Agent, or Firm*—Guy McClung

(57) ABSTRACT

New wellbore milling systems and methods of their use have been developed, the milling system in one aspect including at least one mill, at least one stabilizing member connected to and above the at least one mill, and the at least one stabilizing member for maintaining position of the at least one mill for milling through the liner into the main wellbore. In certain aspects multiple spaced-apart stabilizers are used above a mill which, in one aspect, may include one or more reaming stabilizers. In one aspect the lowermost stabilizer is spaced-apart from a mill so that the stabilizer does not enter a bend portion of a liner to be milled until milling has commenced.

15 Claims, 28 Drawing Sheets

U.S. PATENT DOCUMENTS

| | | | | |
|---|---|---|---|---|
| 2,685,431 | | 8/1954 | James . | |
| 2,797,893 | | 7/1957 | McCune et al. | 166/50 |
| 2,999,541 | * | 9/1961 | Kinzbach et al. | 166/55.7 |
| 3,397,746 | * | 8/1968 | Link | 166/117.6 |
| 3,938,853 | * | 2/1976 | Jurgens | 175/323 |
| 4,266,621 | | 5/1981 | Brock | 175/329 |
| 4,396,075 | | 8/1983 | Wood et al. | 175/79 |
| 4,610,316 | * | 9/1986 | Boaz | 175/323 |
| 4,699,224 | | 10/1987 | Burton | 175/61 |
| 4,717,290 | | 1/1988 | Reynolds et al. | 407/34 |
| 4,796,709 | | 1/1989 | Lynde et al. | 166/55.6 |
| 4,887,668 | | 12/1989 | Lynde et al. | 166/55.8 |
| 4,938,291 | | 7/1990 | Lynde et al. | 166/55.8 |
| 4,978,260 | | 12/1990 | Lynde et al. | 166/55.6 |
| 4,984,488 | | 1/1991 | Lunde et al. | 166/55.6 |
| 5,010,955 | * | 4/1991 | Springer | 166/298 |
| 5,014,778 | | 5/1991 | Lynde et al. | 166/55.6 |
| 5,038,859 | | 8/1991 | Lynde et al. | 166/55.6 |
| 5,058,666 | | 10/1991 | Lynde et al. | 166/55.6 |
| 5,086,838 | | 2/1992 | Cassel et al. | 166/55.6 |
| 5,150,755 | | 9/1992 | Cassel et al. | 166/297 |
| 5,181,564 | | 1/1993 | Lindley et al. | 166/55.6 |
| 5,199,513 | | 4/1993 | Stewart et al. | 175/73 |
| 5,253,710 | | 10/1993 | Carter et al. | 166/298 |
| 5,289,876 | | 3/1994 | Graham | 166/276 |
| 5,297,630 | | 3/1994 | Lynde et al. | 166/297 |
| 5,301,760 | | 4/1994 | Graham | 175/61 |
| 5,311,936 | * | 5/1994 | McNair et al. | 166/50 |
| 5,322,127 | | 6/1994 | McNair et al. | 166/313 |
| 5,337,808 | | 8/1994 | Graham | 166/191 |
| 5,341,873 | | 8/1994 | Carter | 166/117.5 |
| 5,353,876 | | 10/1994 | Curington et al. | 166/313 |
| 5,373,900 | | 12/1994 | Lynde et al. | 166/297 |
| 5,409,060 | | 4/1995 | Carter | 166/237 |
| 5,425,417 | | 6/1995 | Carter | 166/117.6 |
| 5,427,177 | | 6/1995 | Jordan, Jr. et al. | 166/50 |
| 5,429,187 | | 7/1995 | Beagrie et al. | 166/55.1 |
| 5,435,400 | | 7/1995 | Smith | 175/61 |
| 5,452,759 | | 9/1995 | Carter et al. | 166/117.6 |
| 5,456,312 | | 10/1995 | Lynde et al. | 166/55.6 |
| 5,462,120 | | 10/1995 | Gondouin | 166/380 |
| 5,477,925 | | 12/1995 | Trahan et al. | 166/382 |
| 5,520,252 | | 5/1996 | McNair | 166/313 |
| 5,526,880 | | 6/1996 | Jordan, Jr. et al. | 166/291 |
| 5,551,509 | | 9/1996 | Braddick | 166/55.7 |
| 5,651,415 | | 7/1997 | Scales | 166/250.09 |
| 5,655,614 | | 8/1997 | Azar | 175/404 |
| 5,657,820 | * | 8/1997 | Bailey et al. | 166/55.7 |
| 5,678,634 | | 10/1997 | Rehbock et al. | 166/377 |
| 5,680,901 | | 10/1997 | Gardes | 166/313 |
| 5,697,438 | | 12/1997 | Rehbock et al. | 166/55.7 |
| 5,697,445 | | 12/1997 | Graham | 166/313 |
| 5,715,891 | | 2/1998 | Graham | 166/313 |
| 5,727,629 | | 3/1998 | Blizzard, Jr. et al. | 166/298 |
| 5,730,221 | | 3/1998 | Longbottom et al. | 166/298 |
| 5,730,224 | | 3/1998 | Williamson et al. | 166/386 |
| 5,732,773 | | 3/1998 | Parks et al. | 166/117.5 |
| 5,735,350 | | 4/1998 | Longbottom et al. | 166/313 |
| 5,787,987 | | 8/1998 | Forsyth et al. | 166/313 |
| 5,806,596 | | 9/1998 | Hardy et al. | 166/298 |
| 5,806,614 | | 9/1998 | Nelson | 175/61 |
| 5,813,465 | | 9/1998 | Terrell et al. | 166/298 |
| 5,829,518 | | 11/1998 | Gano et al. | 166/55.7 |
| 5,832,997 | | 11/1998 | White et al. | 166/117.6 |
| 5,833,003 | | 11/1998 | Longbottom et al. | 166/298 |
| 5,842,528 | | 12/1998 | Johnson et al. | 175/45 |
| 5,845,707 | | 12/1998 | Longbottom | 166/50 |
| 5,845,710 | | 12/1998 | Longbottom et al. | 166/313 |
| 5,845,722 | | 12/1998 | Makohl et al. | 175/101 |
| 5,853,049 | | 12/1998 | Keller | 166/380 |
| 5,988,272 | * | 11/1999 | Bruce | 166/55.6 |

OTHER PUBLICATIONS

"Catalog 1958–59," Kinzbach Tool Co., Inc., pp. 6, 7, 8; 1958.

"General Catalog 68–69," A–1 Bit & Tool Co., p. 136.

"Who Has Mills That Are Diamond Tough," Homco, 1974.

* cited by examiner

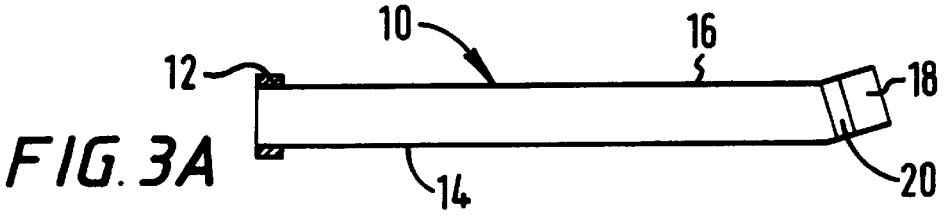
FIG. 3A
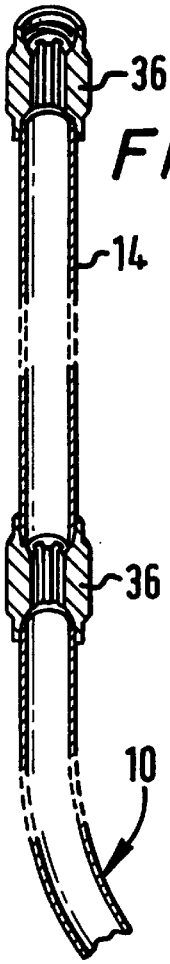
FIG. 3B
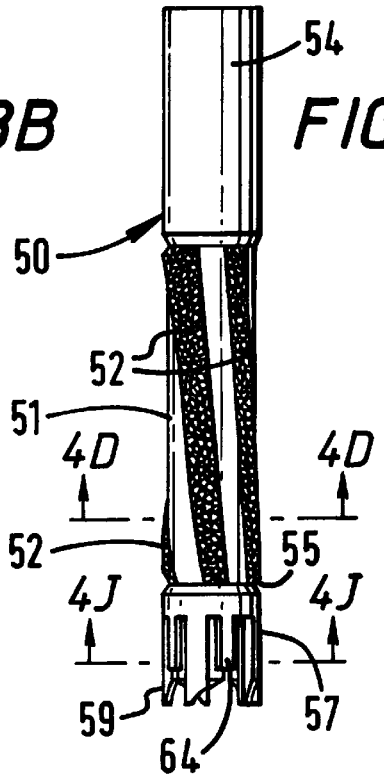
FIG. 4A
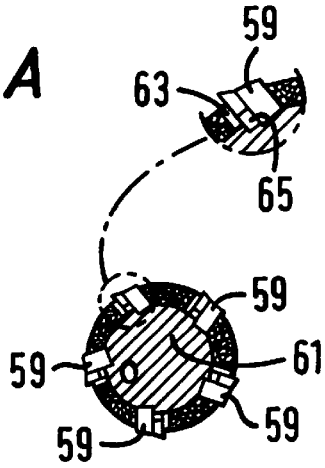
FIG. 4C
FIG. 4B
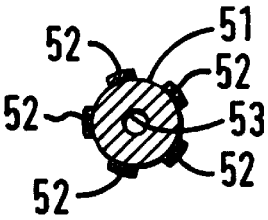
FIG. 4D
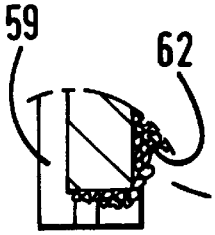
FIG. 4F
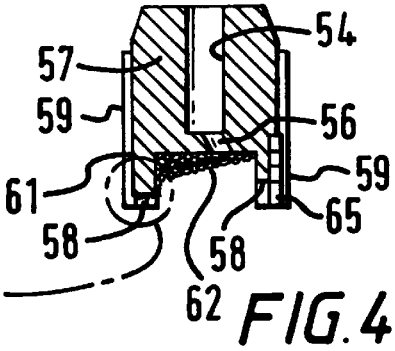
FIG. 4E
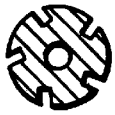
FIG. 4J FIG. 4G
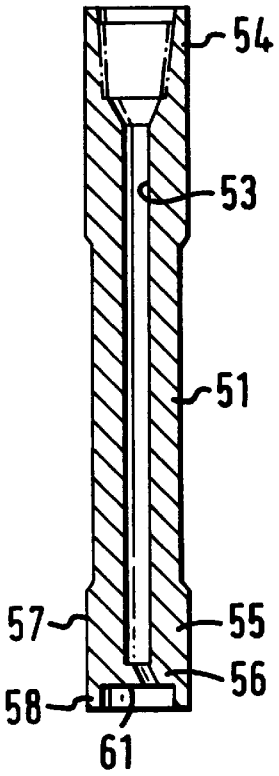
FIG. 5A
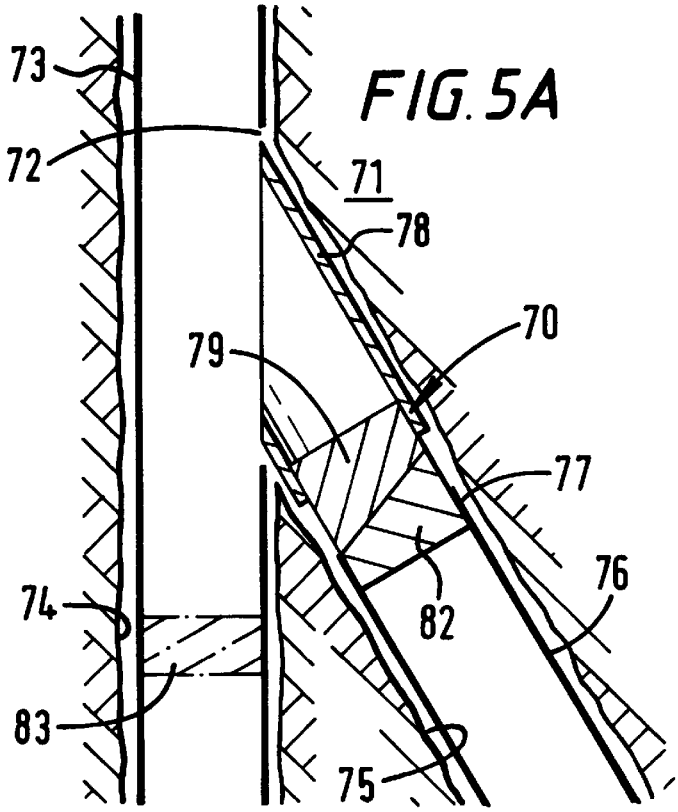
FIG. 4H
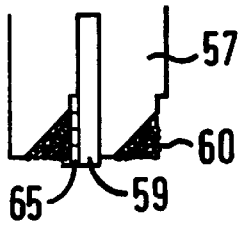
FIG. 5B
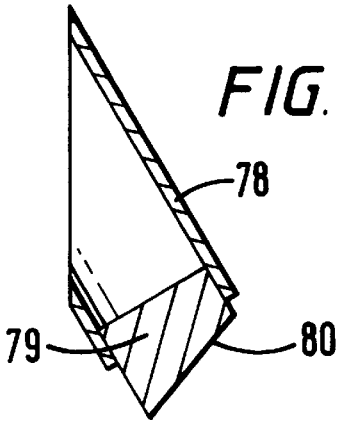
FIG. 4I
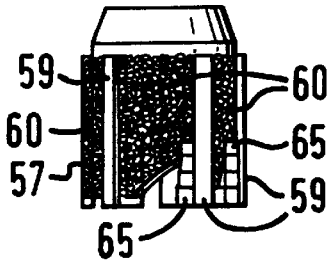
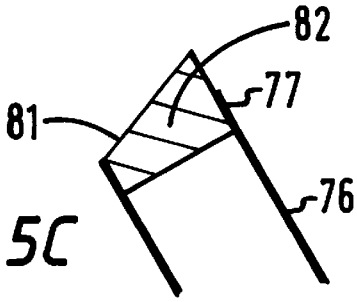
FIG. 5C

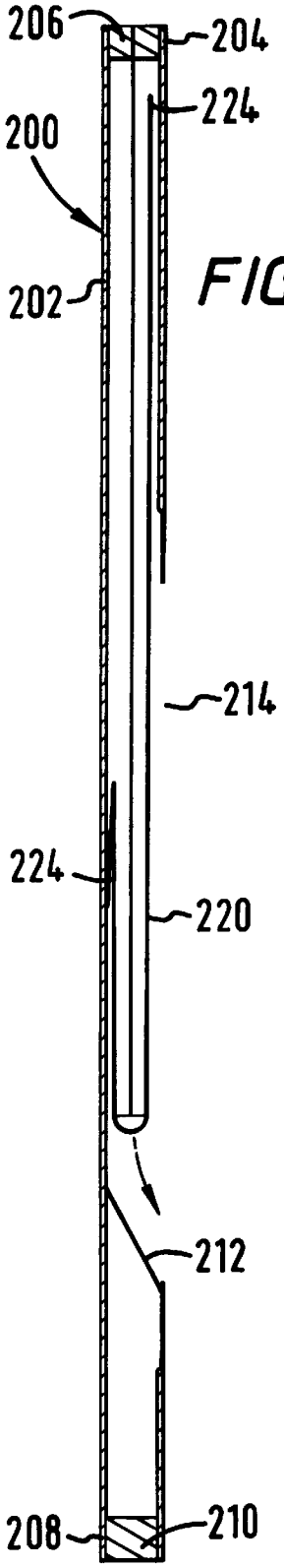
FIG.16A
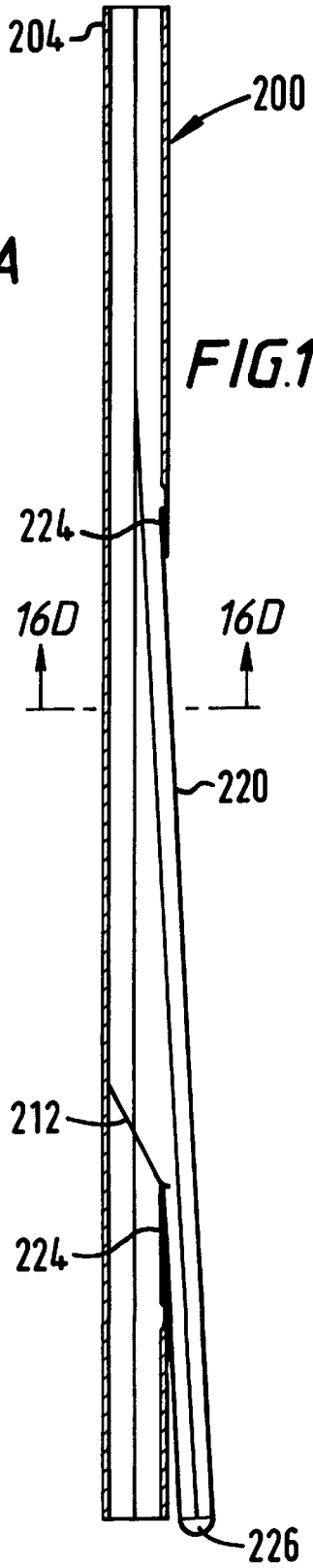
FIG.16B
FIG.16C
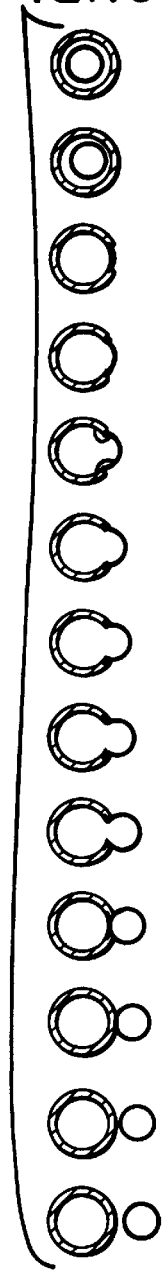

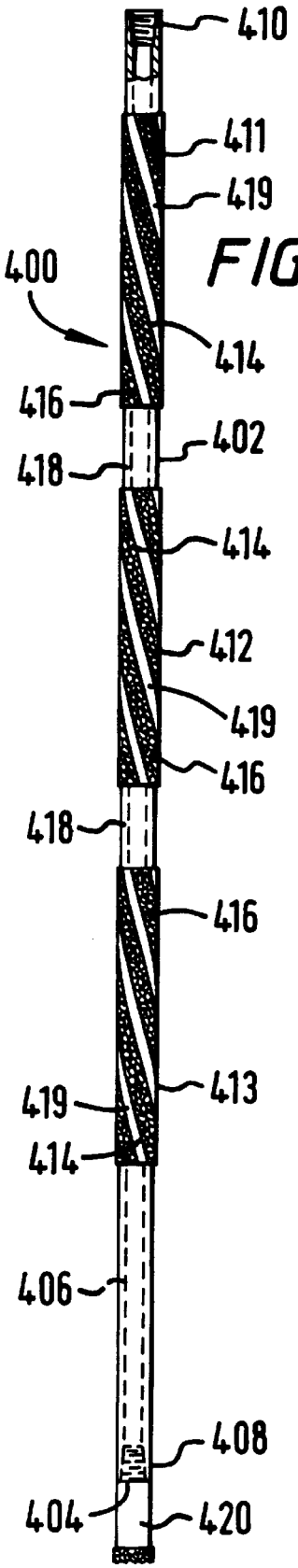
FIG. 17
FIG. 18A
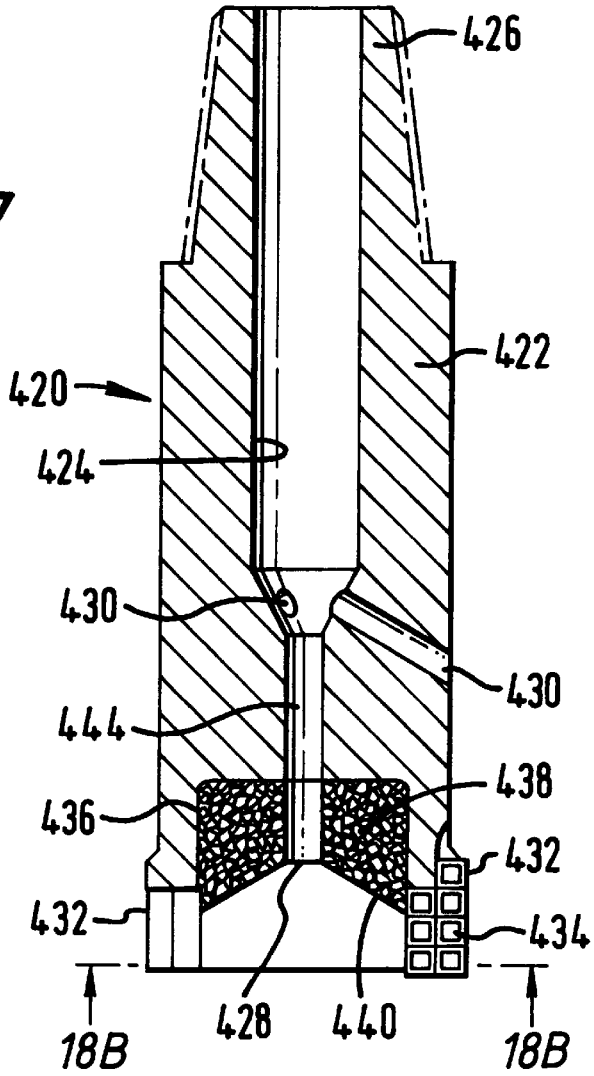
FIG. 18B
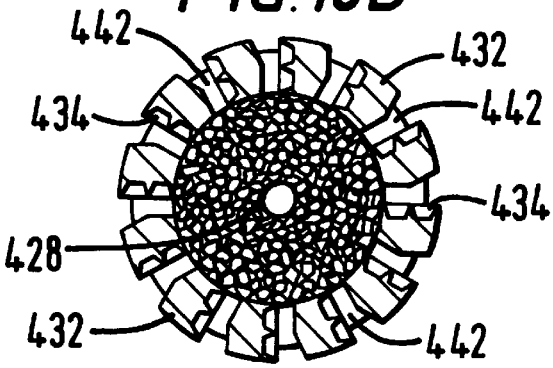

765
766
762
762
760
763
771

755
712
755

756
757
752
752
754
750
758

714
791

748
740
744
747
742

788
784
780
786

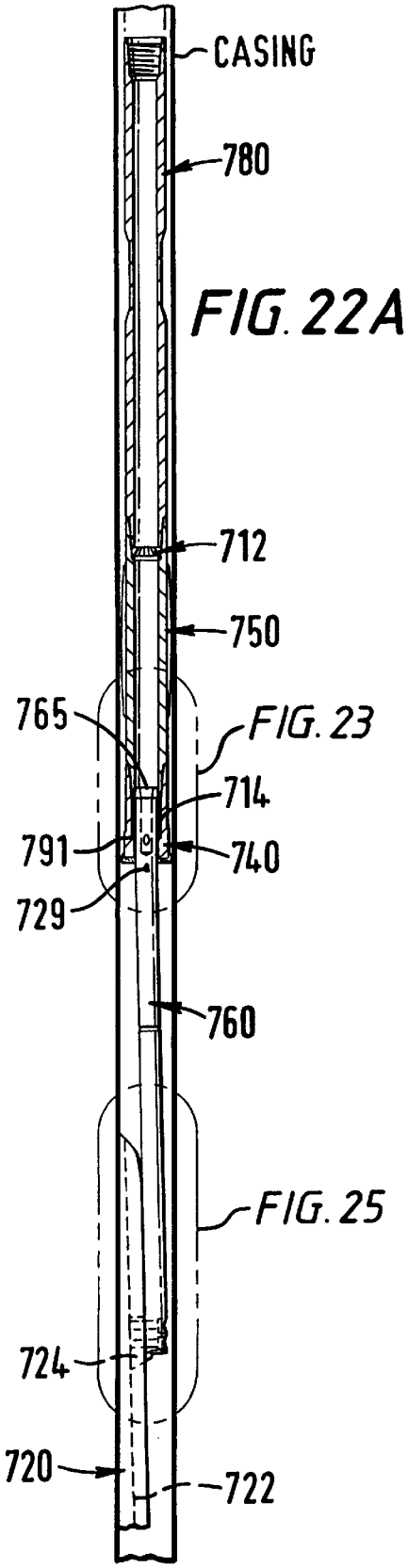
CASING
780
FIG. 22A
712
750
765
FIG. 23
714
791
740
729
760
FIG. 25
724
720
722
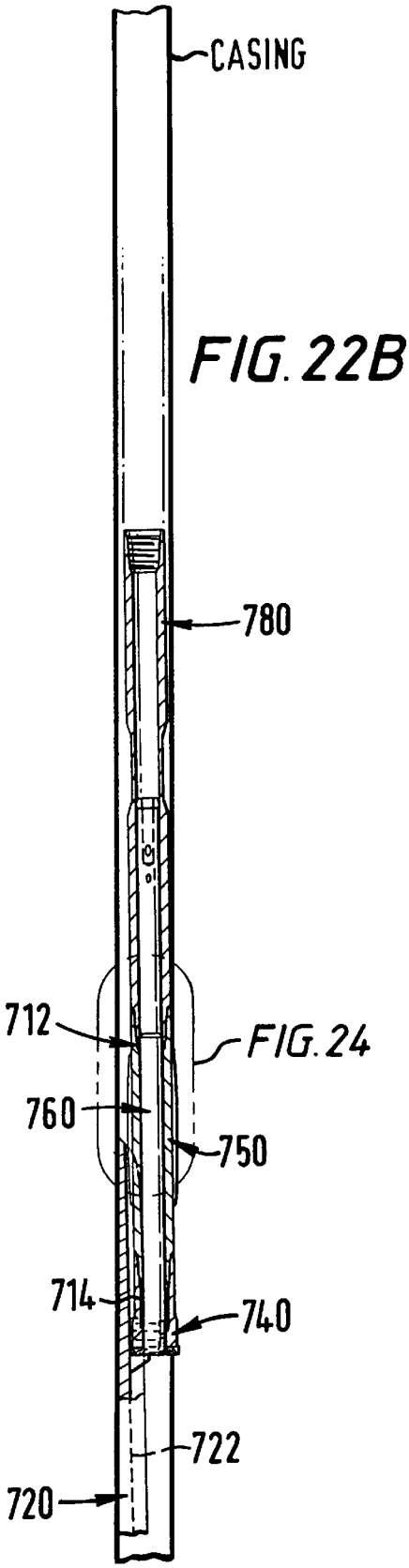
CASING
FIG. 22B
780
712
FIG. 24
760
750
714
740
722
720

800
808
802
804
806
812
804

800
808
802
38C
812
814
810
38C
812
804

812
814
812
800
812

824
822
836
832
837
839
820
826
830
838
832
834
828
836

844
840
842
858
852
854
846
850
852
848
856

WELLBORE MILLING METHODS

RELATED APPLICATIONS

This is a continuation-in-part of U.S. application Ser. No. 09/053,254 filed Apr. 1, 1998, now U.S. Pat. No. 6,070,665 which is a continuation-in-part of U.S. application Ser. No. 08/642,118 filed May 2, 1996, now U.S. Pat. No. 5,806,595 issued Sept. 15, 1998. This is a continuation-in-part of U.S. application Ser. No. 08/962,162 filed Oct. 31, 1997, now U.S. Pat. No. 6,024,168 which is a continuation-in-part of U.S. application Ser. No. 08/752,359 filed Nov. 19, 1996, now U.S. Pat. No. 5,787,978 entitled "Multi-Face Whipstock With Sacrificial Face Element" and of U.S. application Ser. No. 08/590,747 filed Jan. 24, 1996, now U.S. Pat. No. 5,727,629 entitled "Wellbore Milling Guide." U.S. application Ser. No. 08/590,747, now U.S. Pat. No. 5,727,629 is a continuation-in-part of U.S. application Ser. No. 08/414,201, Mar. 31, 1995, now U.S. Pat. Nos. 5,531,271, issued Jul. 2, 1996; Ser. No. 08/300,917, Sept. 6, 1994, now U.S. Pat. No. 5,425,417, issued Jun. 20, 1995; U.S. Ser. No. 08/225,384, Apr. 4, 1994, now U.S. Pat. No. 5,409,060, issued Apr. 25, 1995; U.S. Ser. No. 08/119,813, Sept. 10, 1993, now U.S. Pat. No. 5,452,759; issued Sept. 26, 1995; and U.S. Ser. No. 08/210,697, Mar. 18, 1994, now U.S. Pat. No. 5,429,187, issued Jul. 4, 1995. U.S. application Ser. No. 08/752,359, now U.S. Pat. No. 5,787,978 is a continuation-in-part of U.S. Ser No. 08/655,087, Jun. 3, 1996, U.S. Pat. Nos. 5,620,051 issued Apr. 15, 1997 and U.S. Ser. No. 08/414,338, Mar. 31, 1991 issued Jun. 4, 1992; and of U.S. application Ser. No. 08/542,439 filed Oct. 12, 1995, now U.S. Pat. No. 5,720,349. All of the above-mentioned patents and patent applications are incorporated fully herein for all purposes.

BACKGROUND OF THE INVENTION

1. Field of the Invention

This invention is directed to wellbore milling systems and methods; and, in one particular aspect, to such systems and methods for milling through a liner that projects into a lateral wellbore from a main wellbore to re-establish a pathway to the main wellbore.

2. Description of Related Art

The prior art discloses a wide variety of wellbore milling systems and methods and a wide variety of systems and methods for re-establishing a pathway through a main wellbore after lining a lateral wellbore with a liner. Many such prior art systems and methods require a guide for a milling system so that the milling system mills back through the liner rather than entering the liner itself and milling in the wrong location. Without such a guide a lateral liner can be damaged by the wrongly located milling system, and the pathway through the main wellbore will not be re-established.

Various prior art systems which do not employ a mill guide use a milling system on a rotatable tubular string. If such a string is not sufficiently stiff and is not sufficiently stable, a mill at the end of the string may preferentially attempt to enter a lateral liner rather than mill through the liner to reestablish communication through another (e.g. primary) wellbore.

SUMMARY OF THE PRESENT INVENTION

The present invention, in certain aspects, discloses a milling system for milling through a portion of a lateral liner that projects up into a primary wellbore and which, prior to milling, blocks the lower portion of the primary wellbore. In one particular aspect such a system includes a mill or mills on the end of a tubular string. Disposed above the mill(s) are one or more rigid stabilizing members. The length of one stabilizing member or the combined length of a series of stabilizing members is sufficient to hold the mill(s) against the liner portion to be milled and to prevent the mill from going into the lateral liner itself.

In one particular aspect the stabilizing member(s) is/are sufficiently long that the mill(s) is/are held against the liner while the mill(s) start an opening through the liner. In another aspect the stabilizing member(s) is/are sufficiently long that the mill(s) is/are stabilized sufficiently for milling of the entire opening through the liner.

In a particular embodiment the stabilizing member(s) is/are sized so that space between the exterior of the stabilizing member(s) is minimized, thus preventing stabilizing member wobble which would reduce the stabilizing effect at the mill. In one aspect to achieve this "special drift" tubulars, e.g. casing, are used in the wellbore for the liner. In one aspect of the present invention employing the special drift casing, the drift diameter is in close tolerance to the nominal inner diameter of the tubular string in which it is used. Certain special drift casing has a known interior diameter within a close tolerance, e.g. within forty thousandths of an inch. Also, the exterior diameter of the stabilizing member (s) is, optionally and preferably, sized within a close tolerance, e.g. fifteen thousandths of an inch. The resulting close fit between stabilizing member(s) and casing increases stiffness of the system and enhances stability of the mill(s). In one aspect special drift casing is used at such a length that it includes within it the milling assembly and the area for forming a window.

In one particular aspect the stabilizing member(s) is/are a bladed and/or spiralled-body stabilizer with hardfacing and/or other matrix milling material on the blades and/or spiral part exterior. Such a structure provides for reaming of a portion of a casing that may be slightly out of tolerance and which would, without such reaming, prevent passage of the system through the casing. A reamed portion subsequently provides a desired very close fit with the stabilizing member (s).

In certain embodiments a plurality of stabilizing members are used, e.g., but not limited to, any suitable known stabilizer and/or stabilizer reamer. In one particular aspect spacing is provided between each of a plurality of stabilizers. In certain embodiments, a first stabilizing member above a lower mill is spaced apart from the mill so that the stabilizing member does not enter a bend in the liner (as it projects into the lateral wellbore) until milling has commenced at a desired liner location. In another aspect the stabilizing member is so located that the mill mills through the liner before the stabilizing member enters the bend.

One particular mill useful in such systems has a generally cylindrical body with a flow bore therethrough from a top end to a bottom end. One or more flow ports extend laterally from the flow bore to the body's exterior. The lower end of the mill has a plurality of spaced-apart blades for milling the liner. In various aspects there are two, four, six, eight, ten, or twelve separate blades, although any suitable number is within the scope of this invention. The blades may be dressed with any suitable known matrix milling material and/or inserts by any suitable known method and in any suitable known pattern or array. In one particular aspect the blades extend downwardly with flow paths therebetween and an amount of crushed carbide is disposed within the mill partially adjacent and partially above the blades with a lower cone shape that facilitates maintenance of the mill in a desired milling position.

In one embodiments a system as described above (and in detail below) is releasably secured to a liner and the entire combination is run into a wellbore so that the liner enters and lines a portion of a lateral wellbore. Any suitable known diversion device, whipstock, diverter, etc. may be located in the primary wellbore at a desired location to direct the liner into the lateral wellbore. Following correct emplacement of the liner, the mill(s) is/are selectively released from the liner (e.g. by shearing a shearable member, stud, or pin) and the liner is milled to reestablish communication to the primary wellbore. The mill(s) and interconnected apparatuses are then removed from the wellbore. This operation can be completed in a single trip of the system into the wellbore.

Alternatively, mills and milling systems described herein may be used for any wellbore milling operation, e.g., but not limited to milling a window in a wellbore tubular, milling a fish, a packer, a whipstock, or other apparatus or structure in a wellbore. In other embodiments any mill or mill system described herein may be used in conjunction with a mill guide.

The present invention, in one aspect, discloses a milling system for milling through a lateral bore liner to re-establish a main wellbore. In one aspect the milling system includes a mill with milling blades dressed with milling matrix material and milling inserts; a tubular string connected to and above the mill; and at least one centralizer, rotating centralizer, stabilizer, rotating stabilizer, coupling bushing or the like through which the tubular string extends, the at least one coupling bushing disposed in the main wellbore above a casing window through which the lateral liner extends into the lateral bore.

In one aspect such a system has a plurality of spaced-apart coupling bushings disposed above the lateral bore which serve to position the milling system and prevent it from entering the lateral liner. Such coupling-bushing will facilitate directing of the milling system in the direction of the main wellbore so that the milling system mills through the liner in the direction of the main wellbore, thereby re-establishing the main wellbore. In one aspect one of the coupling bushings is placed above, and in one aspect near the top of, the window at the beginning of the lateral bore.

In some systems a lateral bore liner is supported by an external casing packer, liner hanger, pack-off liner hanger, or similar support positioned in a main wellbore. A milling system as described above that is introduced into the liner through the main wellbore should not abut or hang up on the top of the support apparatus. To facilitate movement of such a milling system past and through an external casing packer a centering apparatus is releasably connected at the bottom of the milling system. As the milling system approaches the top of the external casing packer, the centering device contacts the top of the external casing packer with the lower end of the milling system centered over the bore into the liner. Further downward force on the string to which the milling system is attached releases the centering device and the milling system enters the liner.

In one aspect of a milling system as described herein a coupling bushing has inner slots from top to bottom and/or external ribs to promote fluid flow through and/or around the coupling bushing. Thus circulation for mill cooling and/or cuttings and debris removal is possible.

In one aspect entry of a liner into a lateral wellbore is facilitated by using a bent sub or a bent member at the end of the liner. Also, an orienting apparatus may be used at the end of the liner.

The present invention also discloses systems and methods for shrouding a main bore/lateral liner interface in areas in which formation may be exposed or unsupported.

The present invention discloses systems and methods for installing a liner in a lateral wellbore, the liner having a preformed window located so that, upon desired emplacement of the liner, the preformed window is located above a main wellbore from which the lateral wellbore extends. In this way the preformed window, in one aspect, is positioned over a diverter or whipstock used to direct the liner into the lateral wellbore. Thus a mill is insertable and movable to and through the preformed window to mill through the diverter or whipstock, re-establishing the main wellbore.

It is, therefore, an object of at least certain preferred embodiments of the present invention to provide:

New, useful, unique, efficient, nonobvious devices and methods for milling through a lateral bore liner to re-establish a main wellbore;

Such systems and methods in which one or more coupling bushings, centralizers, stabilizers, and/or similar items are used on a string to which the milling system is connected to position the milling system and inhibit its undesired entry into a lateral liner; and Such systems and methods with a centering device releasably connected to the milling system for facilitating its entry into a top opening of a liner in the main wellbore.

It is, therefore, an object of at least certain preferred embodiments of the present invention to provide:

New, useful, unique, efficient, nonobvious systems and methods for shrouding a main wellbore/lateral wellbore interface and excluding formation from entering therein.

It is, therefore, an object of at least certain preferred embodiments of the present invention to provide:

New, useful, unique, efficient, nonobvious systems and methods in which a liner having a preformed window is installed with part of the liner in a lateral wellbore and the preformed window located in a main wellbore from which the lateral wellbore extends.

The present invention, in one embodiment, discloses a well sidetracking operation which uses a tool including a whipstock with a concave face; a starting bar releasably secured to the whipstock, and in one aspect secured to the concave face; and a milling apparatus including one or more milling tools and having a central opening for receiving an end of the starting bar and a hollow interior for receiving a substantial portion of the body of the starting bar as milling proceeds, the starting bar guiding the mill(s) as the milling apparatus is moved downwardly toward the whipstock. In one embodiment the tool includes a hollow window mill mounted below a hollow finishing mill, with a hollow pup joint (e.g. fifteen feet long) connected to the finishing mill. The pup joint receives the starting bar (which has passed through the hollow mills), casing sliver and a core. A portion of the casing that enters into and is held within the pup joint and within the hollow mill(s) is an amount of casing that does not need to be and is not milled by the milling tools. In other words, as the hollow mill (or mills) with an opening in the bottom end move down, as viewed from above, there is not cutting or milling occurring at the mill(s)'s center where the opening is located; so the mill cuts two slots or lines down a side of the casing (when it is not on high center). The portion of casing between the slots or lines simply moves up into the mills and into the pup joint and the mills do not mill this portion of casing. In certain embodiments at least a portion of a core-catching channel in the mill body is off center to facilitate movement of the mill away from a top-dead-center position with respect to the mill, thereby inhibiting damaging "coring" of the mill. Coring occurs when the piece of tubular moving up into a mill damages the mill and/or the mill is unable to cut or twist off such a piece.

In one embodiment apparatus is provided for securing the starting bar to the milling apparatus so that the starting bar does not fall out of the milling apparatus once it has been received therein. For example, a retaining spring or snap ring with one or more fingers mounted in the finishing mill is disposed and configured to snap into a groove or recess on the starting bar once the starting bar has moved sufficiently into the milling apparatus (and into an interconnected hollow tubular, e.g. a pup joint) to position the groove or recess adjacent the spring or ring.

In one embodiment, a core catcher mounted between the mills is used to catch and hold a core, a piece of casing, slivers milled from the casing, and other debris so that they are removed from the wellbore when the tool is removed.

In one embodiment a packer whipstock is used in conjunction with an anchor packer and the whipstock is oriented using an orienting stinger on the bottom end thereof.

In one embodiment in which apparatus according to this invention is used in a single-trip milling method, a pin or bar extending through a hole in the top of the starting bar initially prevents the first hollow mill (lowest mill) from further pushing down around the starting bar. Initially the mill receives and holds only a top portion of the starting bar. The mill contacts and pushes against the pin so that the whipstock and associated apparatus is moved down onto the anchor packer. When milling commences, the first mill (e.g. a window mill) mills off this pin. Preferably the multiple hollow mills rotate and move down the whipstock to cut out a desired window without requiring any further tool trips into the wellbore.

In another embodiment of the present invention a two-trip milling method is disclosed in which on a first trip apparatus including a starting mill secured to a top of a whipstock concave member with a shear bolt is run into a cased wellbore. This apparatus is run into a cased wellbore to contact an anchored device such as an anchor packer. After the apparatus is anchored on the anchor device and oriented, milling commences and the starting mill, after shearing the shear bolt, mills out an initial pocket in the casing. The starting mill is then removed. For the second trip into the wellbore, a tool as previously described including everything above the starting bar (but without a starting bar) is run into the wellbore and used as previously described, swallowing an unmilled portion of the casing and other material.

The present invention discloses, in certain embodiments, a wellbore mill having a body having a top and a bottom and a first fluid flow channel extending longitudinally therethrough from top to bottom, the first fluid flow channel having an upper end and a lower end, milling apparatus on the body, the lower end of the first fluid flow channel having an opening sized for receiving a core of material from a tubular member milled by the mill, and at least a portion of the first fluid flow channel offset from the remainder thereof to facilitate separation of the core from the tubular member; such a mill with at least one side fluid flow channel having an inner end in fluid communication with the first fluid flow channel and an outer end in fluid communication with a space outside the mill so that fluid pumped down the first fluid flow channel flows out into the space; any such mill wherein the first fluid flow channel includes an upper portion and a lower portion, the upper portion extending through the body of the mill and the lower portion extending through the body of the mill at an angle to the upper portion so that separation of a core with an upper end passing through the lower portion and into the upper portion is facilitated by receipt of said core upper end in the upper portion of the first fluid flow channel; any such mill with the mill body including a top body and a bottom body connected to the top body, the top body including the upper portion of the first fluid flow channel and the bottom body including the lower portion of the first fluid flow channel; any such mill with a coupling interposed between and connecting together the top body and the bottom body, the coupling having a coupling fluid flow bore therethrough in fluid communication with the upper portion of the first fluid flow channel of the top body and with the lower portion of the first fluid flow channel of the bottom body; any such mill wherein the coupling fluid flow bore has an inner diameter larger than an inner diameter of the upper portion of the first fluid flow bore and larger than an inner diameter of the lower portion of the first fluid flow bore; any such mill wherein the upper portion of the first fluid flow bore is offset from the lower portion of the first fluid flow bore, the coupling disposed so that entry of a core top end into the upper portion of the first fluid flow bore is inhibited, the core top end passing from the lower portion of the first fluid flow bore into the coupling fluid flow channel; any such mill wherein the lower portion of the first fluid flow channel has a lower opening at a bottom of the body; any such mill wherein the lower opening is located substantially at a center of a lower portion of the body; any such mill wherein the lower portion of the first fluid flow channel is located substantially at a center of the body, the upper portion thereof is offset from said center, and the first fluid flow channel has an intermediate portion interconnecting the upper and lower portions and at an angle to each of said upper and lower portions; any such mill wherein a first portion of the first fluid flow channel is located substantially at a center of the body, a second portion thereof is offset from said center, and the first fluid flow channel has an intermediate portion interconnecting the first and second portions and at an angle to each of said first and second portions; any such mill wherein the body has a center at its lowest portion and the lower opening is offset from said center; any such mill wherein the body has a lower end with a lower surface thereacross, said lower surface inclined upwardly from an outer edge of the lower end up to a central point of the lower end to facilitate movement of the mill outwardly from a tubular member being milled in a wellbore; any such mill wherein the body has a lower end having an outer lower surface around a circumference of the body, said outer lower surface tapering inwardly from a level above a lowest boundary of the lower end to said lowest boundary; any such mill wherein the body has a lower end with an extended outer circumferential surface positionable substantially parallel to and for co-acting with an inner surface of a mill guide in a wellbore; any such mill including a mill guide in contact with the body of the wellbore mill, said mill guide having hollow body with an upper end and an upper end opening and a lower end with a lower end opening, the lower end opening having a slanted portion to permit the mill to contact an interior portion of the tubular in the wellbore at the desired milling location while the mill also contacts a portion of the lower end of the mill guide.

The present invention discloses, in certain embodiments, a wellbore milling method for milling an opening in a selected tubular of a tubular string in a wellbore, the method including installing a mill on a working string into the wellbore at a selected desired point for milling the opening in the tubular, the mill having a body with milling apparatus thereon and having a top and a bottom and a first fluid flow channel extending longitudinally therethrough from top to bottom, the first fluid flow channel having an upper end and a lower end, the lower end of the first fluid flow channel having an opening sized for receiving a core of material from a tubular member milled by the mill, and at least a portion of the first fluid flow channel offset from the remainder thereof to facilitate separation of the core from the tubular member, and rotating the mill to mill an opening in the selected tubular; such a wellbore milling method including creating a core of material of the selected tubular member by milling down the selected tubular, said core received through said opening into at least the lower end of the first fluid flow channel, and separating with said mill said core from said selected tubular member; any such milling method including positioning a mill guide in said tubular string in said wellbore, said mill guide comprising a hollow body with an upper end and an upper end opening and a lower end with a lower end opening, the lower end opening having a slanted portion to permit the mill to contact an interior portion of the tubular in the wellbore at the desired milling location while the mill also contacts a portion of the lower end of the mill guide, and urging said mill toward said selected tubular with said mill guide; any such milling method wherein there is at least one side fluid flow channel having an inner end in fluid communication with the first fluid flow channel and an outer end in fluid communication with a space outside the mill so that fluid pumped down the first fluid flow channel flows out into the space and the method also including pumping fluid out from the outer end of the side fluid flow channel to move milled material up away from the mill; any such wellbore milling method including positioning a whipstock in said tubular string in said wellbore, and contacting said whipstock with said mill to divert said mill toward said selected tubular; any such milling method including rotating said mill with a downhole motor disposed in said working string; any such milling method wherein the working string is a string consisting of tubulars from the group consisting of pipe and coiled tubing.

The present invention discloses, in certain embodiments, a wellbore mill having a mill body with milling apparatus thereon and a top and a bottom and a side exterior surface, at least one flushing fluid flow channel extending down from the top of the body to an exit opening on the side exterior surface, fluid pumpable from above the wellbore mill down into the flushing fluid flow channel and out from the exit opening to move material milled by the wellbore mill up away from the wellbore well, and a core channel extending from a bottom center opening at a bottom of the mill body and up thereinto for receiving a core of material from a tubular milled by the wellbore mill, the core channel at an angle to a longitudinal axis of the mill body; such a wellbore mill wherein the core channel has a top end within the mill body beyond which the core does not move or the core channel having a core channel opening on the side exterior surface through which a portion of the core may move; any such wellbore mill with at least one intermediate fluid flow channel within fluid communication with the at least one flushing fluid flow channel and the core channel for providing flushing fluid into the core channel; any such wellbore mill wherein the at least one intermediate fluid flow channel is at an angle of at least 90° to the core channel; any such wellbore mill with a mill guide in contact with the body of the wellbore mill, the mill guide having a hollow body with an upper end and an upper end opening and a lower end with a lower end opening, the lower end opening having a slanted portion to permit the mill to contact an interior portion of the tubular in the wellbore at the desired milling location while the mill also contacts a portion of the lower end of the mill guide.

The present invention discloses, in certain embodiments, a wellbore mill with a body having a top and a bottom, milling apparatus on the body, and a core bore insert channel extending up from the bottom of the body for receiving a core bore insert for holding therein; any such wellbore mill with a first core bore insert within the core bore channel, the first core bore insert having a first core channel therethrough with a first diameter for receiving a core milled from a wellbore tubular; any such wellbore mill wherein the core bore insert is removably held in the core bore channel; any such wellbore mill with at least one second core bore insert emplaceable in the core bore insert channel of the wellbore mill body, the at least one second core bore insert having an inner diameter different from the first diameter of the first core bore insert; any such wellbore mill wherein an amount of milling material is on the lower end of, the entire surface of, or at least a portion of the first core channel to facilitate separation of a core from a tubular.

The present invention discloses, in certain embodiments, a first core bore insert for insertion within a core bore insert channel in a body of a wellbore mill, the core bore insert having a body with a top and a bottom, a first core channel extending from the bottom of the body toward the top and having a first length and a first core channel inner diameter, and the first core channel sized to receive a core milled from a wellbore tubular by the wellbore mill; such a first core bore insert with milling material on all of, the lower end of, or at least a portion of the core channel to facilitate separation of a core from a tubular; any such first core bore insert including at least one additional core bore insert, said at least one additional core bore insert having an inner diameter different than the first core channel inner diameter; any such first core bore insert with at least one additional core bore insert, said at least one additional core bore insert having a length different than the first length; and any such core bore insert wherein a core bore channel extends all the way through the body of the core bore insert from top to bottom.

It is, therefore, an object of at least certain preferred embodiments of the present invention to provide:

New, useful, unique, efficient, non-obvious wellbore mill, milling systems, and methods for milling operations;

Milling apparatus with which milling on high center of a tubular or casing is inhibited;

A wellbore mill having a core receiving channel with at least a portion thereof off-center with respect to a body of the mill; and Any such mill with one or more side fluid flow ports to facilitate the removal of milled material from the wellbore.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 3A is a side cross-section view of a liner assembly according to the present invention. FIG. 3B is a side cross-section view of a casing-coupling system according to the present invention.

FIG. 4A is a side view of a mill according to the present invention with undressed blades. FIG. 4B is a bottom end view of the mill of FIG. 4A. FIG. 4C shows an enlargement of part of the mill as shown in FIG. 4B. FIG. 4D is a cross-section view along line 4D—4D of FIG. 4A. FIG. 4E is a cross-section view of the lower end of the mill of FIG. 4A. FIG. 4F shows an enlarged portion of the mill end shown in FIG. 4E. FIG. 4G is a side cross-section view of the mill of FIG. 4A. FIGS. 4H–4I show side view of details of the lower end of the mill of FIG. 4A. FIG. 4J is a cross-section view along line 4J—4J of FIG. 4A.

FIGS. 5A–5C are side cross-section views of a lateral shroud system according to the present invention.

FIG. 16A, 16B, and 16E are side cross-section views of a liner system according to the present invention. FIG. 16C shows cross-section views along the length of the system as illustrated in FIG. 16B. FIG. 16E shows a sleeve of the system of FIG. 16A installed in a wellbore.

FIG. 17 is a side view partially in cross-section of a mill system according to the present invention.

FIG. 18A is a side view in cross-section of a generally cylindrical mill according to the present invention. FIG. 18B is a bottom end view of the mill of FIG. 18A.

FIGS. 21D–21H are in cross-section.

FIGS. 22A and 22B show the milling system including the parts shown in FIGS. 21A–21H and show steps in the operation of the system.

DESCRIPTION OF EMBODIMENTS PREFERRED AT THE TIME OF FILING FOR THIS PATENT

Figure 1A:
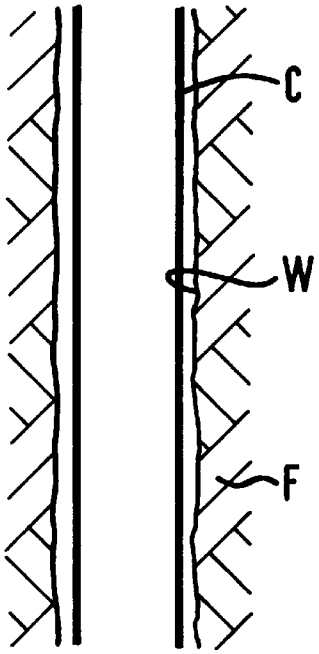
FIG. 1A Prior Art
FIG. 1A shows in a side cross-section view a prior art wellbore extending down from an earth surface into the earth.

Referring now to FIG. 1A, a main wellbore W extends down into an earth formation F and is cased with a string of casing C. Such wellbores and the drilling of them are old and well-known, as are the systems, tubulars, and methods for casing them.

Figure 1B:
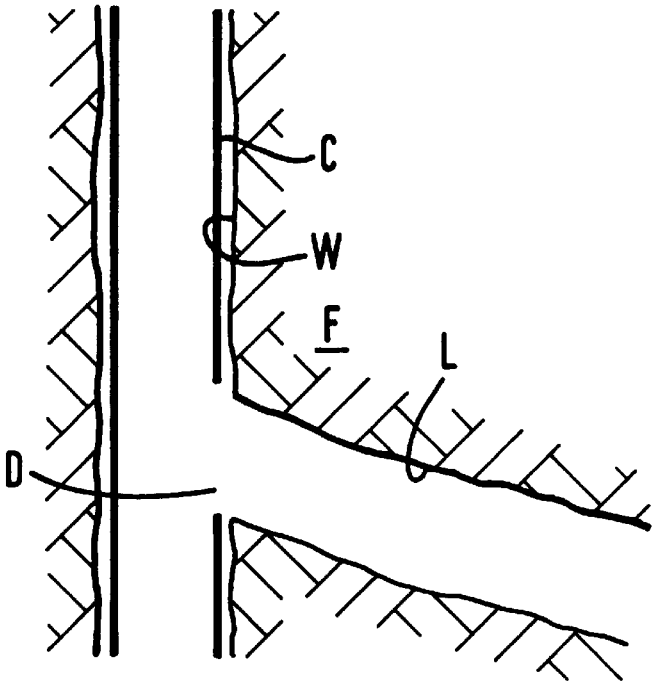
FIG. 1B Prior Art
FIG. 1B shows in side cross-section view of a lateral wellbore extending from the wellbore of FIG. 1A.

FIG. 1B shows the results of well-known window milling methods that have created a window D and well-known drilling methods that have produced a lateral bore L.

Figure 1C:
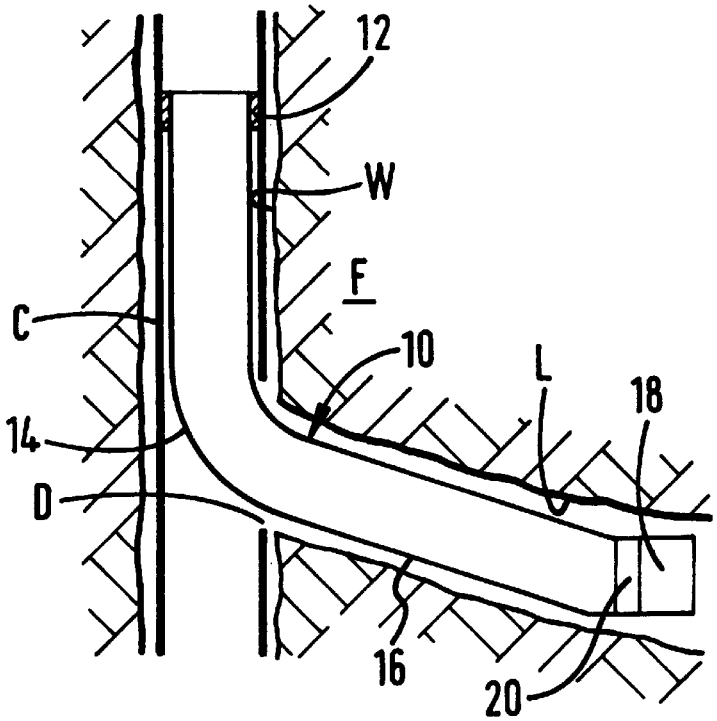
FIG. 1C is a side cross-section view of a liner according to the present invention with a part installed in the lateral wellbore of FIG. 1B.

FIG. 1C shows a liner assembly 10 according to the present invention installed in part of the main wellbore W and part extending into the lateral bore L. It is within the scope of this invention for the part of the liner assembly 10 to extend to any desired length into the lateral base L, including substantially all of the length of the lateral bore L.

A suitable support 12 holds the liner assembly 10 in place. In one aspect, the support 12 is an external casing packer, but it is within the scope of this invention for it to be a liner hanger, tubing hanger, pack off or any support that supports the liner assembly 10. In another aspect, a non-sealing support or supports may be used if no sealing between the exterior of the liner assembly 10 and the casing interior is desired.

A tubular liner 14 may be made from any suitable material such as metal (steel, aluminum, zinc, alloys thereof), composite, fiberglass, or plastic. Preferably, the tubular liner 14 is bendable sufficiently for a lower portion 16 to bend and enter into the lateral bore L. In one aspect a bent tubular or bent sub 18 is connected at the end of the lower portion 16 of tubular liner 14 to facilitate initial entry of the tubular liner 14 into the lateral bore L. Optional seals 13 seal the annular space between a casing 38 and tubular members 14. Optionally, an orienting apparatus 20 (including but not limited to a measurement-while-drilling device) may be used connected to the tubular liner 14 for correcting positioning and orienting of the bent sub 18 and of the tubular liner 14.

Figure 1D:
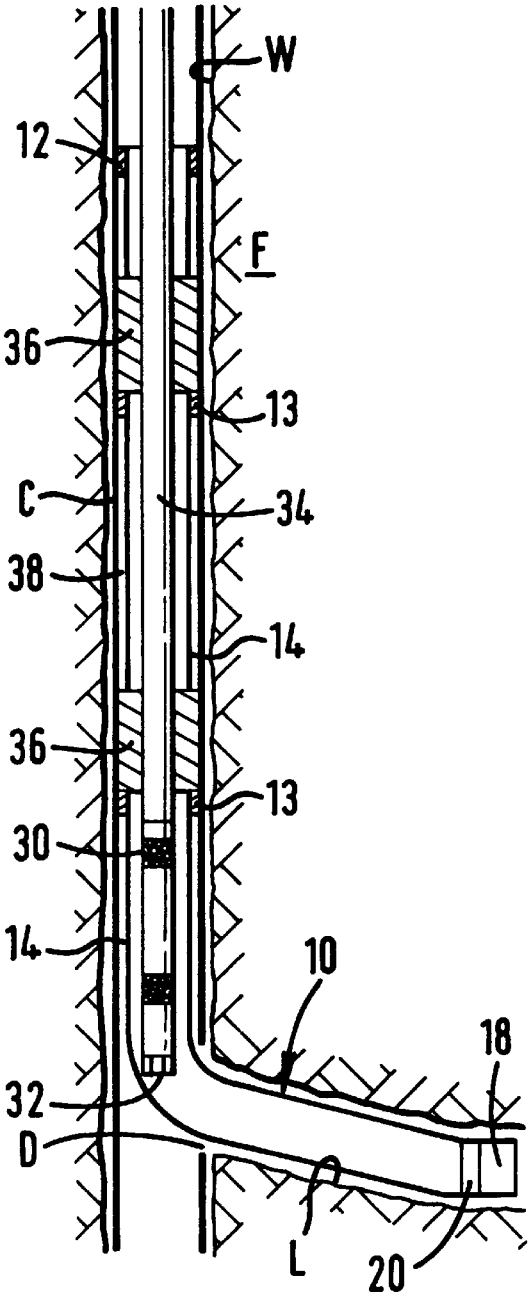
FIGS. 1D–1F are side cross-section views of the wellbore and lateral wellbore of FIG. 1C showing steps on a milling operation with a milling system according to the present invention.
Figure 1E:
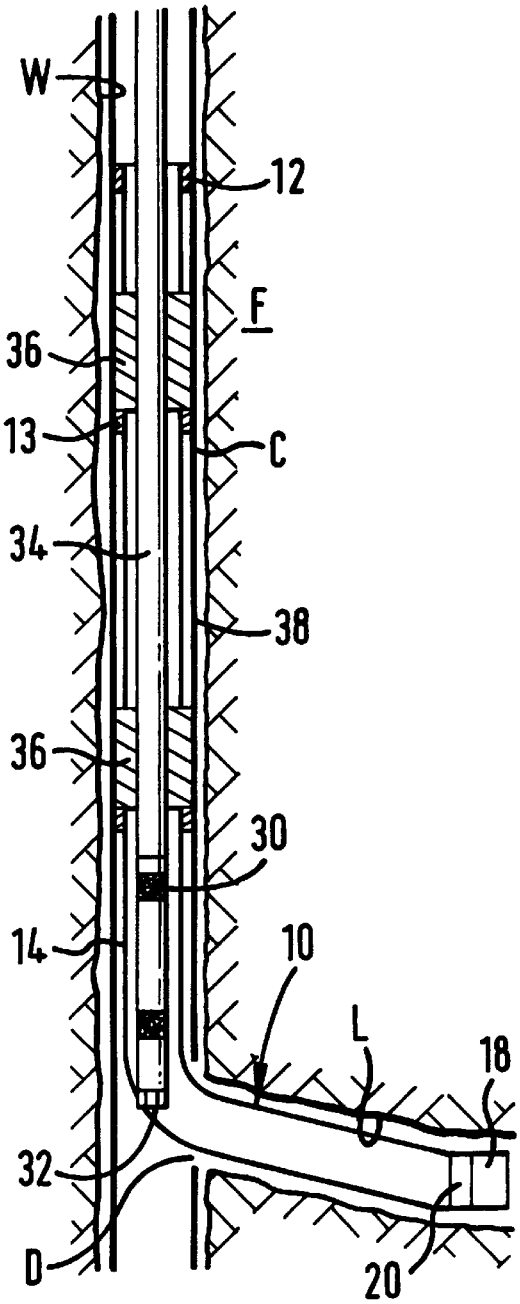
Figure 1F:
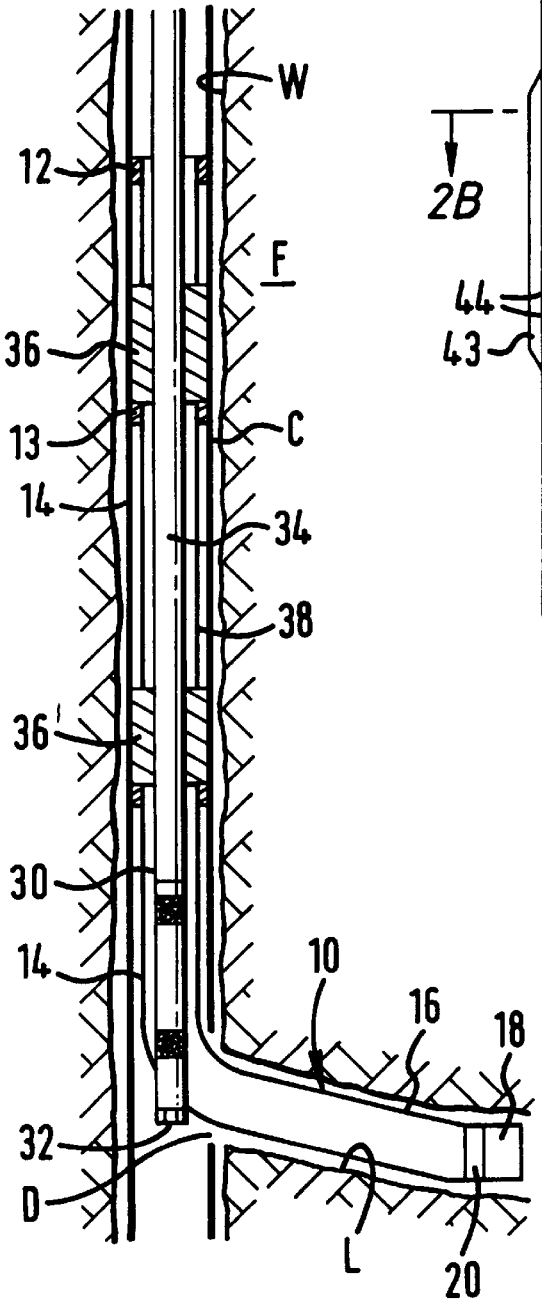

FIGS. 1D–1F illustrate use of a milling system 30 to re-establish a pathway through the main wellbore W after installation of the liner assembly 10 as shown in FIG. 1C. The milling assembly 30 has a mill 32 connected to a tubular string 34 (e.g. a string of drill pipe, spiral drill collars that facilitate fluid circulation, or tubing) that extends to and is rotatable from the earth surface. The wellbore W is cased with casing 38. The tubular string 34 extends movably through one or more (two shown) coupling bushings 36 (which connect together tubulars 14) (see also FIG. 3B). In one aspect a spiral grooved drill collar which facilitates fluid circulation and milled cuttings removal is used between the bushings and/or thereabove; in one aspect, for thirty feet above the mill. Alternatively, a third coupling bushing and/or a fourth may be used between the two coupling bushings shown in FIGS. 1D and 3B. Optionally, a liner hanger may be connected on the top of the top coupling bushing shown in FIG. 3B (in one aspect interconnected via a pup joint) to hold the tubular 14.

The milling system 30 and the tubular string 34 are movable through the tubular liner 14 and through the coupling bushings 36 so that longitudinal (up/down) movement of the milling system 30 is possible. The milling system 30 is also rotated as the tubular string is lowered so that the mill 32 contacts and begins to mill at an interior location on the tubular liner 14. In one aspect the mill 32 simply makes a ledge (in a single trip, preferably) (as in FIG. 1E) in the tubular liner 34 that serves as a starting point for additional milling by another mill or mill system (not shown) that is introduced into the main wellbore W following retrieval of the milling system 30. As shown in FIG. 1F, the milling system 30 may be used to mill through the tubular liner 34, re-establishing the main wellbore W and/or creating a pilot hole which provides the location for further milling by another mill or mill system.

Figure 2A:
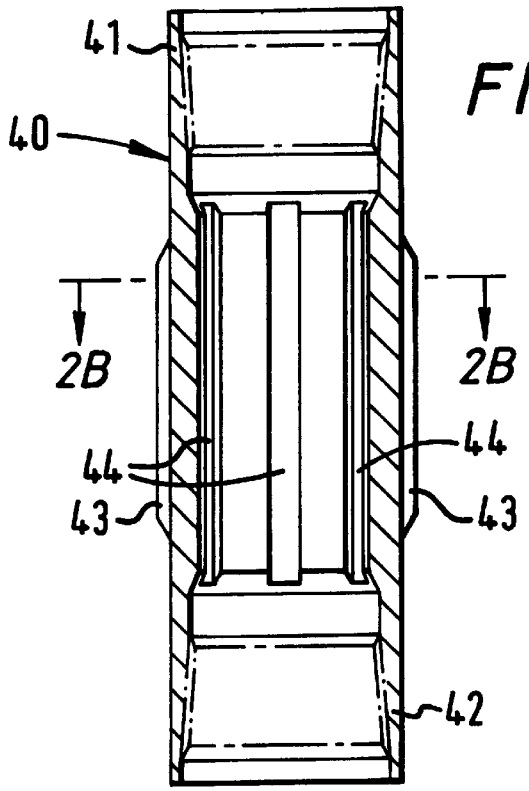
FIG. 2A is a side cross-section view of a generally cylindrical coupling-bushing according to the present invention.
Figure 2B:
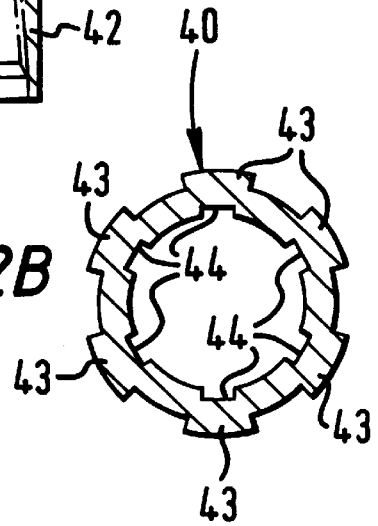
FIG. 2B is a cross-section view along line 2B—2B of FIG. 2A.
Figure 2C:
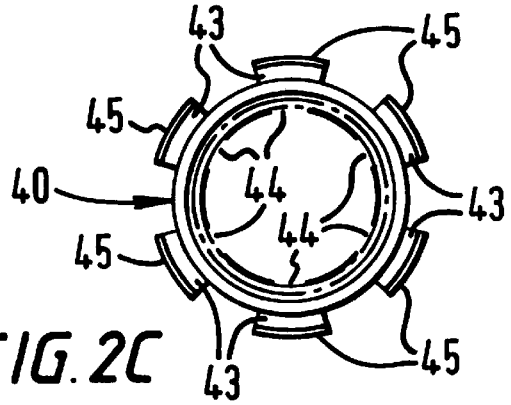
FIG. 2C shows the coupling bushing as in FIG. 2B with tungsten carbide ground smooth on exterior rib surfaces.
Figure 6:
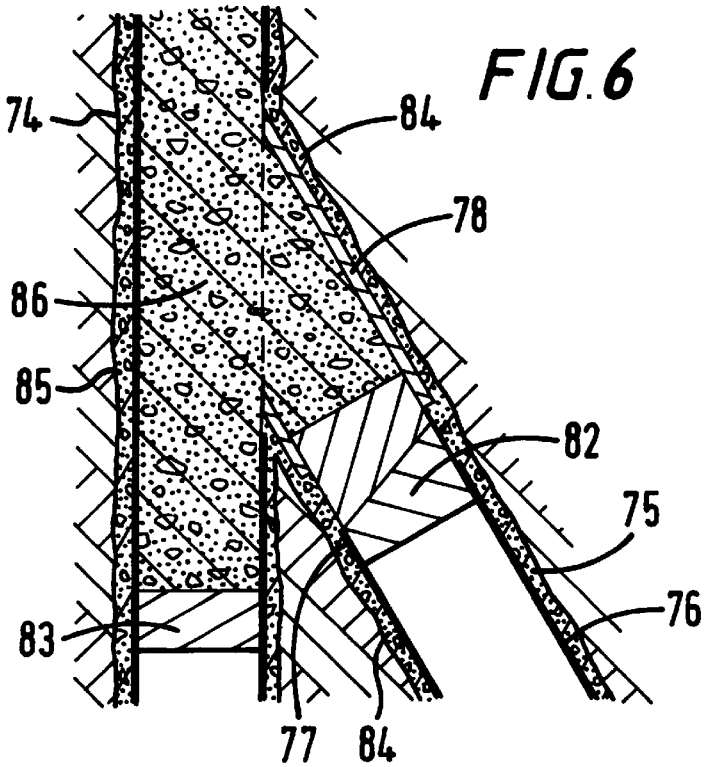
FIG. 6 is a side cross-section view of a lateral shroud system according to the present invention.
Figure 7:
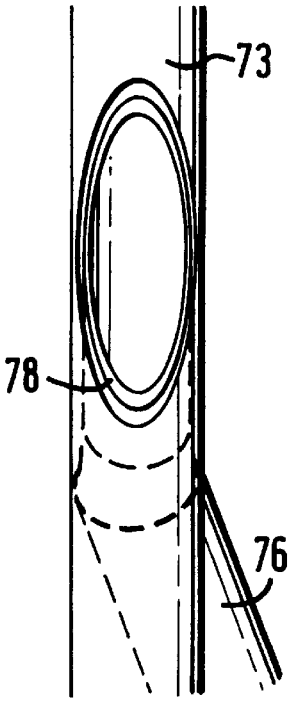
FIG. 7 is a front view of a lateral shroud system according to the present invention.

FIGS. 2A–2C show a coupling bushing 40 usable as a coupling bushing 36 in the milling system 30. The coupling bushing 40 has internally threaded ends 41 and 42 and a series of exterior ribs 43 between which fluid can flow past the exterior of the coupling bushing 40. A series of internal slots 44 provide an internal fluid flow path through the coupling bushing 40. As desired hardfacing or tungsten carbide material 45 may be applied to outer surfaces of the ribs 43.

FIGS. 4A–4J illustrate a mill 50 usable as the mill 32 of the milling system 30. The mill 50 has a body 51 with milling matrix material 52 (and/or blades with milling inserts, not shown) applied spirally to the body 51 by known techniques. The material 52 may rough (e.g. as applied) a ground smooth. As shown in FIG. 4G, a fluid flow bore 53 extends from a top 54 of the body 51 to a bottom 55 where it communicates with an exit port 56 through the bottom 55 of the body 51. Alternatively, additional exit ports may be provided. In one aspect the inserts project beyond milling matrix material.

The lower end of the mill 50 has a ribbed member 57 with a series of downwardly projecting lower portions 58 alternating with and spaced apart from a series of blades 59. Matrix milling material 60 is placed between the blades 59 (covering mid portions 64) and over a lower end 61 of the body 51. In one aspect, as shown in FIG. 4E, the matrix milling material is deposited with a ramp portion 62 to facilitate, enhance, and maintain liner engagement and/or to inhibit or prevent coring of the mill. Preferably a space 63 is left between a blade surface (or surfaces of inserts 65) and the milling matrix material 60 to provide a fluid flow course therethrough. Milling inserts 65 as desired may be applied to the blades 59.

In one aspect the coupling bushings 36 are spaced-apart about ten feet and the tubular string 34 has an outer diameter of about 4⅛ inches. In one aspect the coupling bushing's inner diameter is chosen so that the tubular string 34 fits tightly within, yet is rotatable within, the coupling bushings 36. In one aspect, known spiral drill pipe and/or spiral drill collars (e.g. one or more) are used adjacent and/or above the mill 32.

In one aspect the tubular liner 14 is positioned so that a lowermost coupling bushing is near the top of the window (in one aspect between two and three feet above it). In one aspect the tubular liner is installed, e.g. as in FIG. 1D, and a portion of the tubular liner above the window is removed (e.g. by milling or with an internal cutter) creating a stub end in the wellbore. A coupling bushing or suitable centralizer or stabilizer is emplaced on the stub end and then the milling system is run into the wellbore, through the newly-emplaced coupling bushing, and into the tubular liner.

Spiralled grooves may be provided in the outer surface of the coupling bushings.

FIG. 5A shows a shroud system 70 for excluding earth formation 71 from an interface at a window 72 in a wellbore casing 73 between a main bore 74 and a lateral bore 75. A liner 76 has been emplaced in the lateral bore 75 and a top 77 thereof does not extend upwardly to the window 72. To prevent earth from the formation 71 from falling into the liner or the main wellbore (through the window 71), a hollow shroud 78 with a plug 79 at a bottom thereof having a ramped end 80 is inserted into the lateral bore 75 so that the ramped end 80 matingly abuts a corresponding ramped end 81 of a plug 82 in a top end of the liner 76. Optionally a plug 83 seals off the main bore 74.

In one aspect in the shroud system 70 of FIG. 5A, the liner 76 is run into the lateral bore and cut at a length as shown in FIG. 5A. Then the plug 82 is installed in the liner 76 and the shroud 78 is moved down into the lateral bore 75. If necessary, the shroud 78 is rotated so the ramp 80 seats correctly against the ramp 81. The liner be installed with the plug 82 in place. The plug 83 can be used with an orientation/location apparatus to insure correct positioning of the shroud 78 for entry into the lateral bore 75. Cement 84 may be installed around the shroud 78 and the liner 76. Cement 85 may be installed around the casing 73 (before or after lateral bore creation or lateral bore cementing.)

In certain aspects, the shroud 78 is made of metal (e.g. steel, zinc, bronze, and any alloys thereof), fiberglass, plastic, or composite. The shroud 78 may be solid or hollow, as may be the plugs 79 and 82.

Optionally, following shroud installation, the area in the main bore 74 adjacent the window 72 and some area above and below the window 72 is cemented with cement 86. If the shroud 78 is hollow, it is also cemented interiorly. Then, to regain access to the lateral bore 75, the cement 86 above and in the window 72 is removed or drilled out, as well as cement within the shroud 78 and the plugs 80 and 82. If the shroud 78 is solid, it is drilled through. If it is desired to re-establish flow through the main bore 74 below the window 72, the cement 86 above, adjacent and below the window 72 is removed or drilled through, as well as the plug 83. The plugs 80 and 82 may be solid or hollow.

In an alternative shroud system, rather than a plug on the lower end of the shroud entering a liner, a ring on the lower end of the shroud is positioned over the liner top and sealingly encompasses it.

Figure 8:
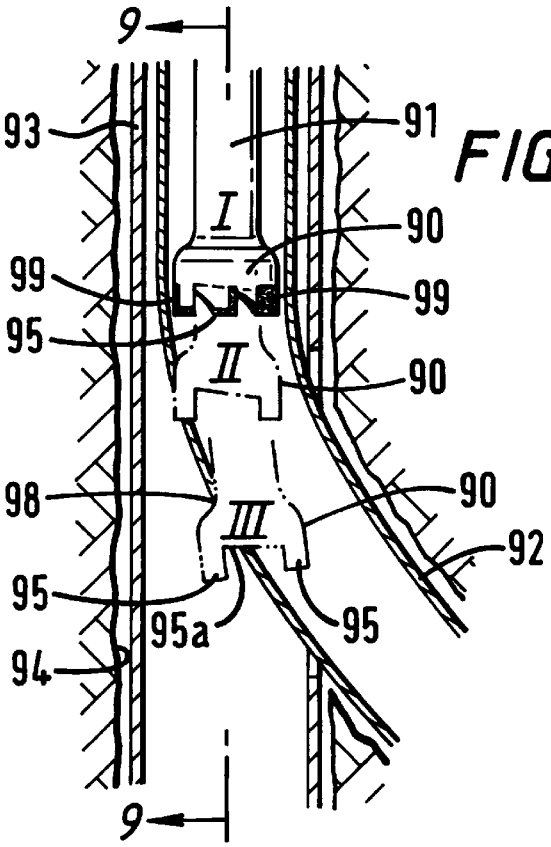
FIG. 8 shows schematically in a side cross-section view a milling operation according to the present invention.
Figure 9:
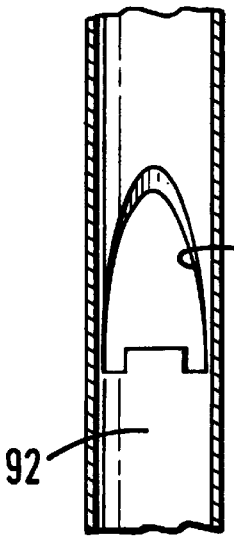
FIG. 9 is a side cross-section view along line 9—9 of FIG. 8 of an opening made with the mill of FIG. 8.

FIG. 8 shows a mill 90 (e.g. usable in the milling system 30, FIG. 1D, as the mill 32) connected to a tubular string 91 (like the string 34, FIG. 1D) in a liner 92 in a casing 93 in a wellbore 94. The mill 90 has downwardly projecting skirt 95 which defines a void area 96. The skirt 95 is dressed with tungsten carbide inserts 99 (e.g. but not limited to those disclosed in U.S. Pat. 5,626,189 and pending U.S. application Ser. No. 08/846,092 filed May 1, 1997 both co-owned with the present invention and incorporated fully herein for all purposes). Roman numerals I, II, III show three different positions of the mill 90. In position I the mill 90 has not yet contacted the liner 92. In position II, the mill 90 has milled an initial ledge 97 in the liner 92. In the position III, the mill 90 has milled an opening 98 in the liner 92 (also shown in FIG. 9). In position II, in one aspect, a lower coupling bushing (e.g. as in FIG. 1D or 3B) close to the mill by its contact with the string 91 inhibits the mill's tendency to deflect away from the liner 92 (i.e. to the right in FIG. 8. In position III, the lower portions 95 of the mill 90 inhibit the mill from stepping off the ledge 97 and from re-entering the liner 92. The lower portions 95 facilitate movement of the mill 90 down the curve of the liner 92. A ramp portion 95*a* inhibits or prevents coring of the mill.

Figure 10:
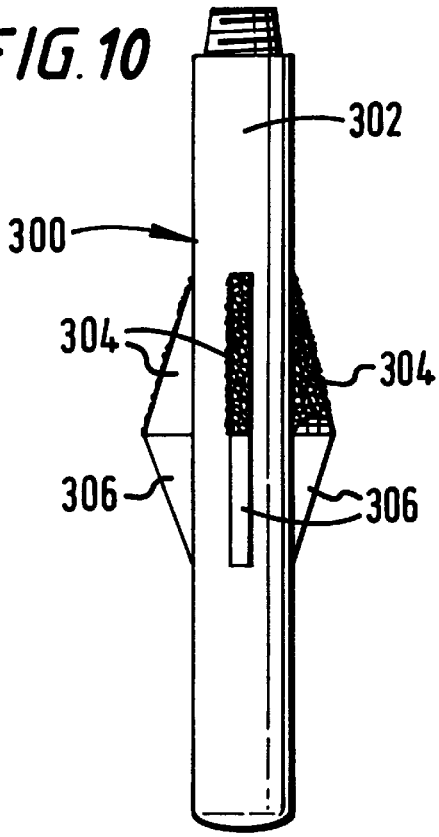
FIG. 10 is a side view of a mill according to the present invention.

FIG. 10 shows a mill 300 according to the present invention with a body 302 and a plurality of blades 304. Associated with each blade 304 is a taper member 306 which is secured to the body 302, or to the blade 304, or to both, either with an adhesive such as epoxy, with connectors such as screws, bolts, or Velcro™ straps or pieces, or by a mating fit of parts such as tongue-and-groove. The taper members may be made of any suitable wood, plastic, composite, foam, metal, ceramic or cermet. In certain embodiments the taper members are affixed to the mill so that upon contact of the lower point of the mill blades with the casing to be milled, the taper members break away so that milling is not impeded.

Figure 11:
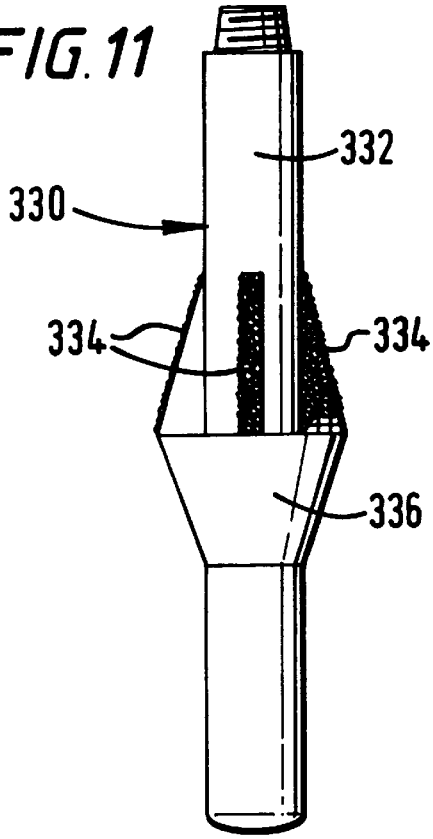
FIG. 11 is a side view of a mill according to the present invention.

FIG. 11 shows a mill 330 according to the present invention with a body 332 and a plurality of blades 334. A taper device 336 is secured around the mill 330 or formed integrally thereon. The taper device 336 extends around the entire circumference of the mill 330 beneath the blades 334 and facilitates movement of the mill 330 through tubulars. The taper device 336 may be a two-piece snap-on or bolt-on device and may be made of the same material as the taper member 306.

Figure 12:
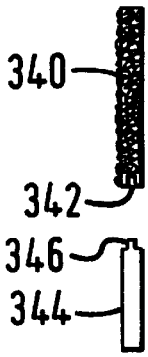
FIG. 12 is a side view of a blade with a taper member according to the present invention.

FIG. 12 shows a blade-taper member combination with a blade 340 having a groove 342 and a taper member 344 with a tongue 346. The tongue 346 is received in the groove 342 to facilitate securement of the taper member 344 to the blade 340. Optionally, an epoxy or other adhesive may be used to glue the taper member to the blade, to a mill body, or to both. The tongue and groove may be dovetail shaped.

Figure 13:
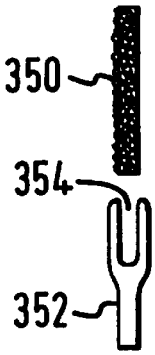
FIG. 13 is a side view of a blade with a taper member according to the present invention.

FIG. 13 shows a blade-taper member combination with a blade 350 and a taper member 352 with a recess 354. The blade 350 is received in and held in the recess 354. Optionally an adhesive may be used to enhance securement of the taper member 352 to the blade, to the mill, or to both.

Figure 14A:
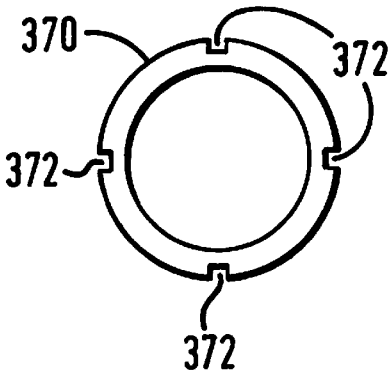
FIG. 14A is a bottom view of a mill body according to the present invention.

FIG. 14A shows a mill body 370 like the bodies of the mills shown in FIG. 5A, 10, and 11, but with a series of grooves 372 therein which extend longitudinally on the mill body and are sized, configured, and disposed to receive and hold a taper member as shown in FIG. 10, FIG. 12, or FIG. 13. Such a mill body may be used instead of or in combination with any previously-described taper securement means.

Figure 14B:
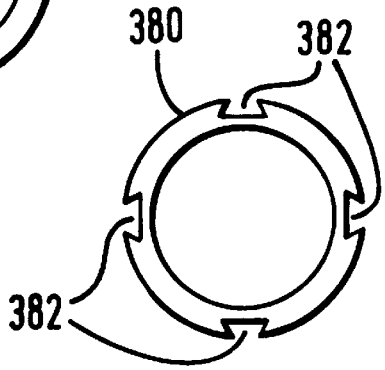
FIG. 14B is a bottom view of a mill body according to the present invention.

FIG. 14B shows a mill body 380 like the bodies of the mills shown in FIGS. 5A, 10, and 11, but with a series of dovetail grooves 382 therein which extend longitudinally on the mill body and are sized, configured, and disposed to receive and hold a taper member as shown in FIG. 10, FIG. 12, or FIG. 13. Such a mill body may be used instead of or in combination with any previously-described taper securement means.

Figure 15A:
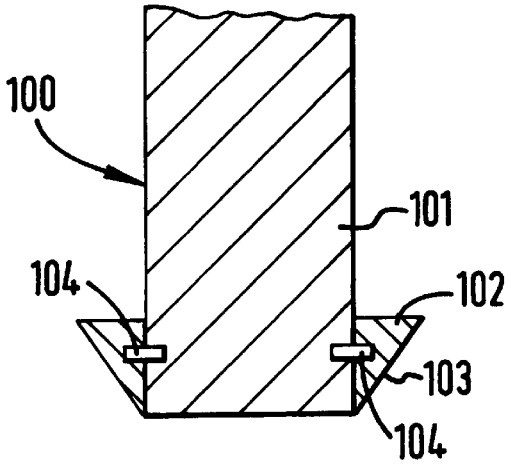
FIG. 15A–15D are side cross-section views of mills according to the present invention.

FIG. 15A shows a mill 100 usable as the mill in any system described herein which has a cylindrical mill body 101 to which is releasably secured a circular ring 102 that tapers from top to bottom with a taper 103. Shearable pins or bolts 104 releasably hold the ring 102 to the mill body 101. The ring 102 is sized to facilitate passage of the mill 100 through a tubular member and also to inhibit undesired abutment of the mill 100 on an edge or surface of a coupling bushing, e.g. as a system as in FIG. 1D is moved down through the coupling bushings 36. Upon contact of the ring 102 with a top of a coupling bushing, the pins 104 shear and the mill 100—which is now positioned of the top entry into the coupling bushing due to the position of the ring 102—easily enters the coupling bushing.

Figure 15B:
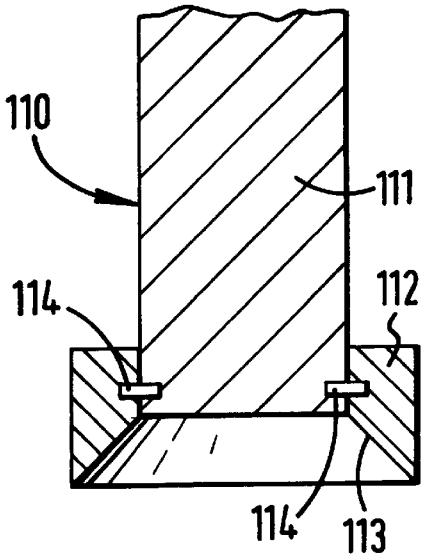

FIG. 15B shows a mill 110 usable as the mill in any system described herein which has a cylindrical mill body 111 to which is releasably secured a ring 112 that tapers from top to bottom with a taper 113. Shearable pins or bolts 114 releasably hold the ring 112 to the mill body 111. The ring 112 is sized to facilitate passage of the mill 110 through a tubular member and also to inhibit undesired abutment of the mill 110 on an edge or surface of a coupling bushing, e.g. as a system as in FIG. 1D is moved down through the coupling bushings 36. Upon contact of the ring 112 with a top of a coupling bushing, the pins 114 shear and the mill 110—which is now positioned of the top entry into the coupling bushing due to the position of the ring 112—easily enters the coupling bushing.

Figure 15C:
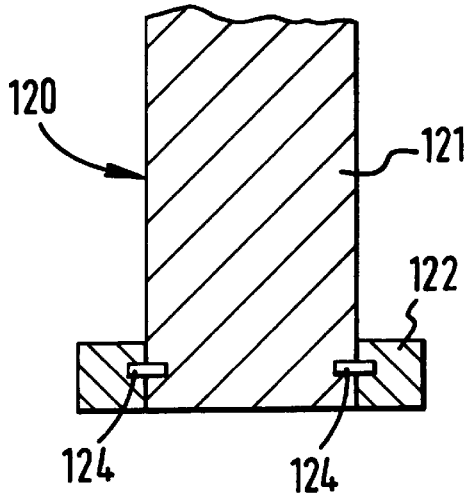

FIG. 15C shows a mill 120 usable as the mill in any system described herein which has a cylindrical mill body 121 to which is releasably secured a circular cylindrical ring 122. Shearable pins or bolts 124 releasably hold the ring 122 to the mill body 121. The ring 122 is sized to facilitate passage of the mill 120 through a tubular member and also to inhibit undesired abutment of the mill 120 on an edge or surface of a coupling bushing, e.g. as a system as in FIG. 1D is moved down through the coupling bushings 36. Upon contact of the ring 122 with a top of a coupling bushing, the pins 124 shear and the mill 120—which is now positioned of the top entry into the coupling bushing due to the position of the ring 122—easily enters the coupling bushing. In one aspect, the rings remain in the wellbore. In certain aspects, the rings are made of steel, brass, phenolic, composite, plastic, metal, or fiberglass.

As any of the mills shown in FIGS. 15A–15C move down into the coupling bushing and further downwardly, the rings 102, 112, and 122 remain atop a coupling bushing and the mill (and related tubulars) move through the ring.

In one aspect the rings are held with shear pins which shear in response to about 500 to 6000 pounds of force, and, in one aspect, about 4000 pounds of force. Shearing of a ring 102, 112, or 122 gives a positive indication at the surface of a precise location in the wellbore and, in certain aspects, a known location at a point above and near the area at which milling will commence.

The mills of FIGS. 15A–15D represent schematically any suitable known mill. Such a mill may be dressed with any known milling matrix material and/or milling inserts in any known array, pattern or configuration by any known application method.

The rings 102, 112, and 122 as shown completely encircle and encompass the cylindrical mill bodies with which they are associated. In certain embodiments acceptable centering of a mill is achieved by a partial ring (e.g. that encompasses about 180 degrees or about 270 degrees of the mill body's circumference) or by individual blocks whose cross-section appears like the cross-sections of the rings in FIGS. 15A–15C, but which are spaced apart around the mill body in certain aspects two, three, four or more such blocks are used with a width, as viewed from above of between about one to about ten inches.

Figure 15D:
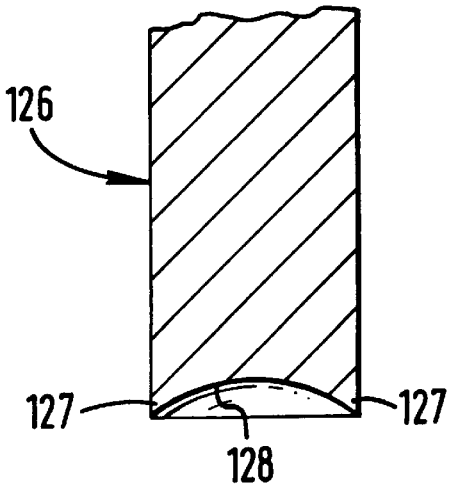

FIG. 15D shows a mill 126 with a cylindrical mill body 125 having a lower concave face 128 having relatively sharp corners 127. Any mill in FIGS. 15A–15D (and any mill disclosed herein) may be dressed with any known matrix milling material, rough or ground smooth; any known milling inserts in any known pattern, array, or combination; any combination thereof; and/or with milling inserts projecting out from and beyond matrix milling material.

Figure 16D:
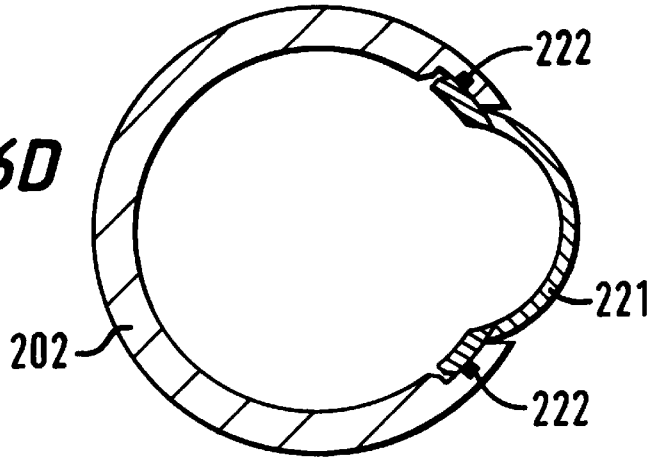
FIG. 16D is a cross-section view along line 16D—16D of FIG. 16B.

FIG. 16A shows a system 200 with a tubular member 202 having a top end 204 with an anchor 206 and a bottom end 208 with a plug, (preferably drillable) 210. An anchor may be provided at the end 208. A bar, whipstock, or diverter 212 is secured at a lower end of a pre-formed or pre-machined window 214 to and within the tubular member 202.

A sleeve 220, e.g. a liner or wellbore tubular, (made e.g. of metal, brass, bronze, zinc, zinc alloy, aluminum, aluminum alloy, fiberglass, or composite) is releasably secured in or is inserted into and through the tubular member 202. The sleeve 220 is moved down to contact the diverter 212 which urges the sleeve 212 to a position as shown in FIG. 16B (e.g. into an already underreamed formation portion or into a lateral bore extending from a main wellbore.

When the sleeve 220 is in the position shown in FIG. 16B an activatable sealing material 222 disposed around the edge of the window 214 is activated to effect sealing securement of the sleeve 220 at the window 214. Preferably a flange 224 formed of or secured to the sleeve 220 extends interiorly beyond the edge of the window 214 to facilitate sealing of the sleeve at the window and to serve as a stop and locking device.

Figure 16E:
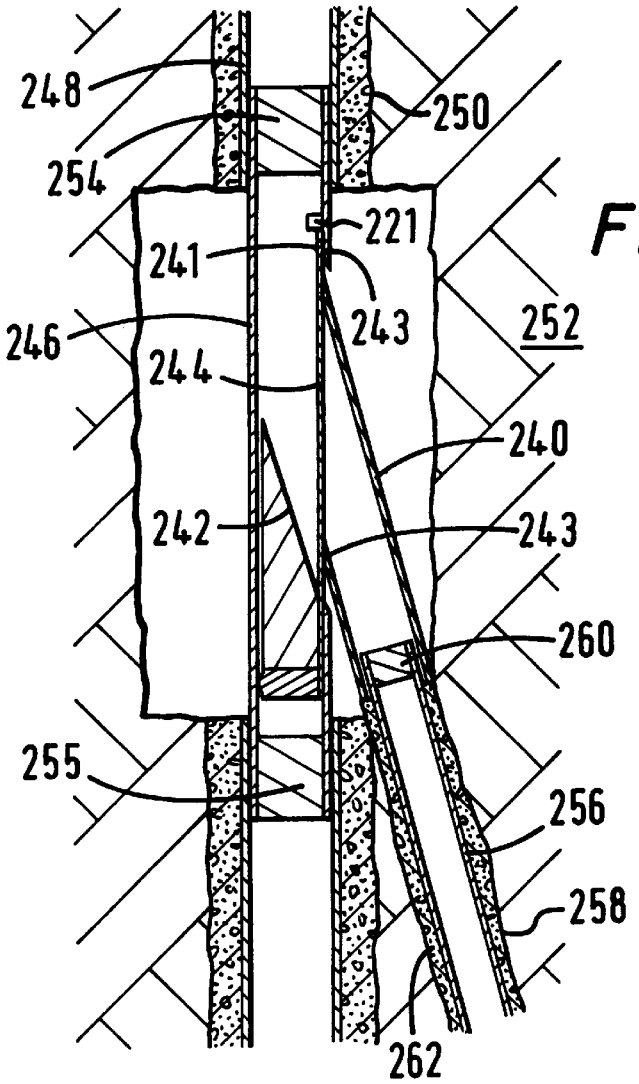

Any suitable stored energy medium may be used as the sealing material 222, including, but not limited to, thermite and other iron oxide-aluminum compounds which react to form a metal seal or weld between parts and which are activated by heat with suitable initiation devices as are well known in the art indicated schematically by the device 221, FIG. 16E.

In one aspect, not shown, the sleeve 220 has an open lower end. As shown in FIGS. 16A and 16B a pressure-containing drillable shoe or end cap 226 seals off the sleeve's bottom end.

In one aspect the diverter 212 is replaceable or removable in the wellbore or at the surface. The sleeve 220 may be any desired length.

As shown in FIG. 16E a sleeve 240 (like the sleeve 220) with a flange 241 has been installed at a pre-formed window 244 of a tubular body 246 installed in a casing 248 of a wellbore 250 extending from an earth surface down in an earth formation 252 and sealed in place with sealing material 243. A top anchor 254 anchors the top of the tubular body 246 in casing 248. A diverter 242 secured within the body 246 (removable or not) has urged the sleeve 240 into an underreamed part of the formation 252 and a liner 256 has been inserted into and through the sleeve 240. The liner 256 (any desired length) extends down into a lateral wellbore 258. A liner hanger or packoff liner hanger 260 is at the top of the liner 256. The liner may be cemented into place with cement 262. An anchor 255 anchors the bottom of the tubular body 246. Alternatively a plug may be used instead of, or in addition to, the anchor 255.

In one aspect a system with a sleeve as shown in FIG. 16A or 16E is run in a well and set, or bridged, across an already milled and under-reamed portion of casing. The sleeve is then pushed down to the diverter and forced out the pre-machined window in the tool body. In this position, the flange on the sleeve is adjacent to a shoulder in the pre-machined window and positioned in place. The stored energy medium reaction is then initiated creating a pressure-containing seal between the flange and the tool body. At this point, a lateral open hole may be drilled or an existing lateral open hole may be lengthened. An additional length of liner may be run into the drilled open hole and hung off the sleeve and then cemented into place.

Alternatively, the lateral open hole is first drilled and then an entire liner string with a flange on top (like, e.g. the flange 241, FIG. 16E) is run into place. A seal is then activated (as with the systems of FIGS. 16A and 16E with sealing material 222 or 243). If desired, the liner is then cemented in place.

In another embodiment, a system as in FIGS. 16A or 16E is run into a new well (without a sleeve or liner in place within the tool body) by placing the tool body directly in a new casing string while running in hole, with slight modifications (e.g. no anchors or plugs are needed) to the tool body. The aforementioned procedures are then followed, with the absence of section milling and under-reaming.

FIG. 17 shows a mill system 400 according to the present invention which includes a tubular member 402 with a lower box end 404 and a flow bore 406 from a bottom end 408 to a top end 410. Stabilizers may be emplaced around a tubular 402 or the tubular 402 with stabilizers may be one piece. Three stabilizers 411, 412, 413 may be integrally formed of or on the tubular 402, e.g. by welding. In one aspect the stabilizers consist of hardface material welded to the tubular body. Spiral grooves 419 extend from the top to the bottom of each stabilizer which define spiral portions 414 of each stabilizer. Optionally, these spiral portions are dressed with crushed carbide 416 or other suitable hardfacing, matrix milling material, and/or milling inserts.

A mill 420 is connected to the lower end 408 of the tubular member 402 and fluid is flowable through the flow bore 406 to and through the mill 420. In one particular specific embodiment, described here by way of illustration and not limitation, the outer diameter of the tubular member 402 is about 4.000 inches; each stabilizer 411, 412, 413 is about three feet long; each space 418 between stabilizers is about ten inches; the distance from the bottom of the stabilizer 411 to the top of the mill 420 is about four feet; the distance from the bottom end of the mill 420 to the top of the stabilizer 411 is about fifteen feet; and the distance from the bottom of the stabilizer 413 to the top end of the tubular member 402 is about twelve feet. This particular specific embodiment of a system 400 may be used with five inch special drift casing with the spiral portions 414 extending outwardly slightly beyond the 4.369 inch drift diameter limit. The spiral portions 414 will ream any portion within the casing up to the 4.375 inch size (e.g. the casing is about 4.369 inches and the stabilizer blades are at 4.375 inches).

FIGS. 18A and 18B show the mill 420 with a generally cylindrical body 422 having a flow bore 424 extending from a top end 426 down to a lower exit port 428. One or more side flow ports 430 entrance the movement of cuttings and debris away from a plurality of spaced-apart milling blades 432 which are dressed with inserts 434. In the embodiment shown there are three ports 430 equally spaced around the body 422. Any suitable known inserts may be used in any suitable known pattern or array for the inserts 434 and/or matrix milling material may be used on the blades. In one aspect the blades 432 of the mill 420 at the lower end of the mill extend outwardly to a larger diameter than an upper part of the body 422*a*. The lowermost inserts on the blades can achieve an aggressive point or small area contact with the tubular to be milled through. Such difference in diameter also facilitates fluid flow from the bottom of the mill upwardly.

A recess 436 in the lower part of the body 422 an amount 438 of the crushed carbide therein (e.g. welded in) whose lower surface 440 is generally cone-shaped to facilitate correct positioning of the mill on casing being cut and to urge the mill toward the parent bore once an initial cut out is achieved through the liner and urged toward the lateral at the bottom of the window creating a longer window. Thus the mill maintains its position so it cuts the lateral liner and so slipping around the bend in the lateral liner is inhibited. Spaces 442 between blades provide for fluid flow. A portion 444 of the bore 424 is shown as vertical (straight) but it may be canted with respect to the bore 424. Alternatively any of the bore configurations disclosed herein including but not limited to those in FIGS. 4E and FIGS. 38B–49B, may be used in the mill 420.

Figure 19:
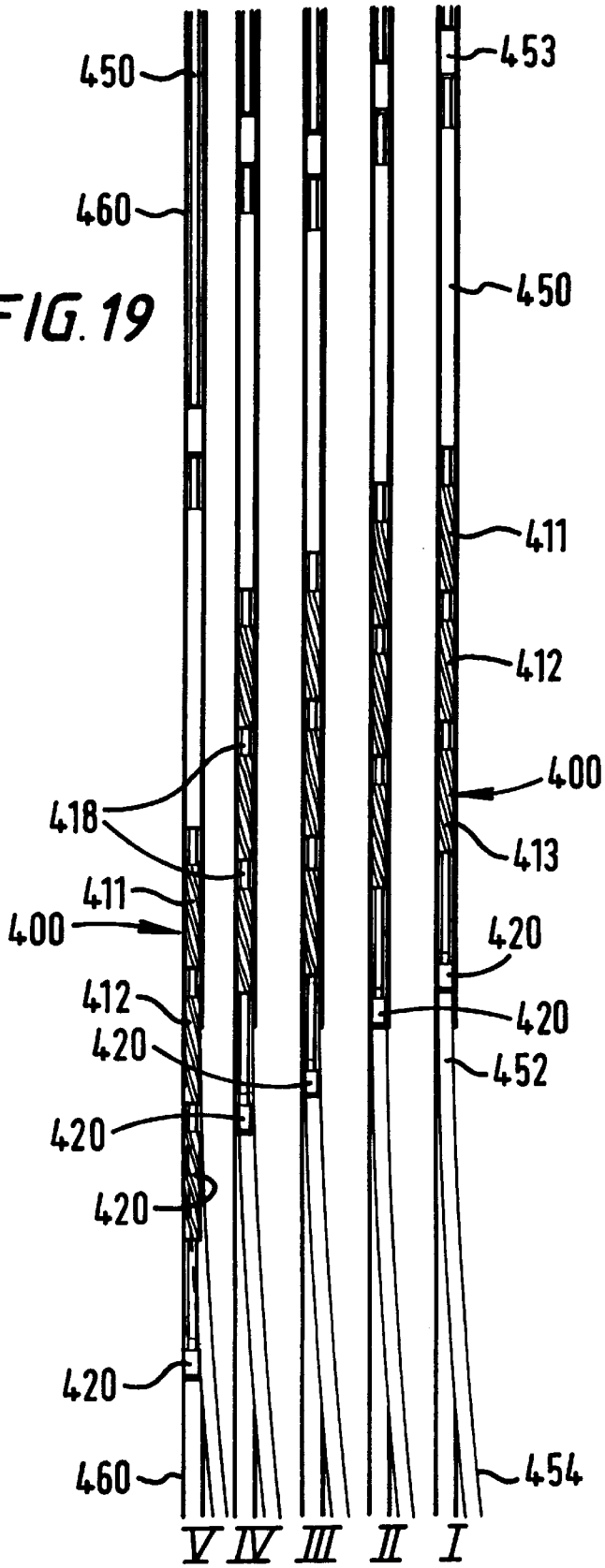
FIG. 19 is a composite side cross-section view of steps in an operation using a system as in FIG. 17.
Figure 19A:
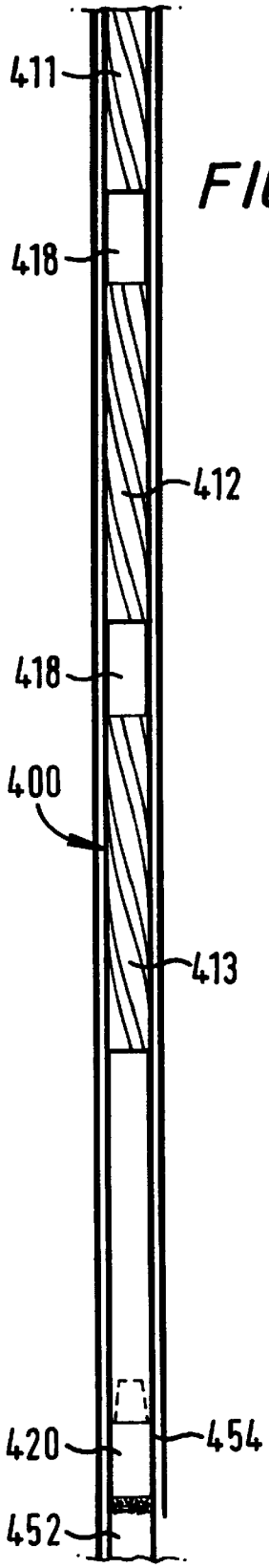
FIGS. 19A–19E are enlarged portions of FIG. 19.
Figure 19B:
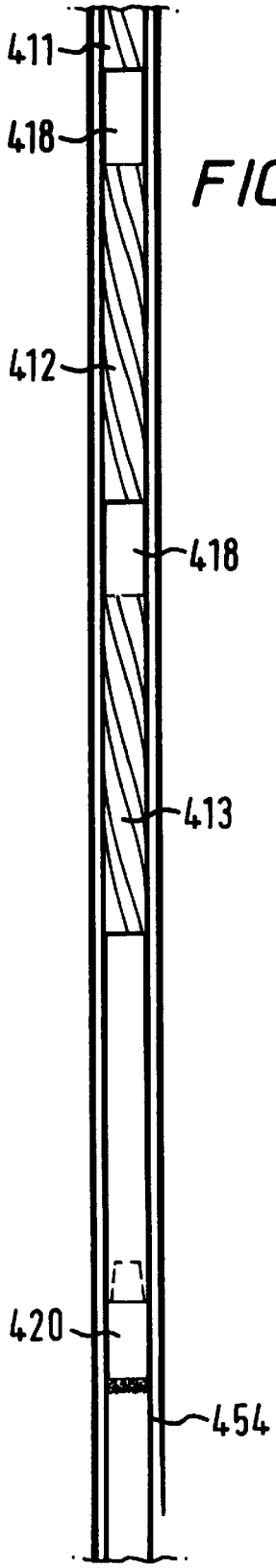
Figure 19C:
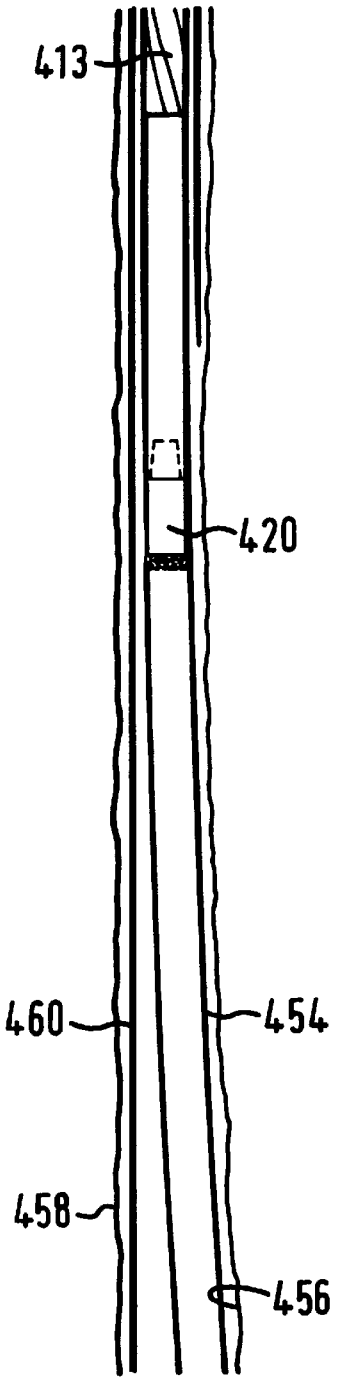
Figure 19D:
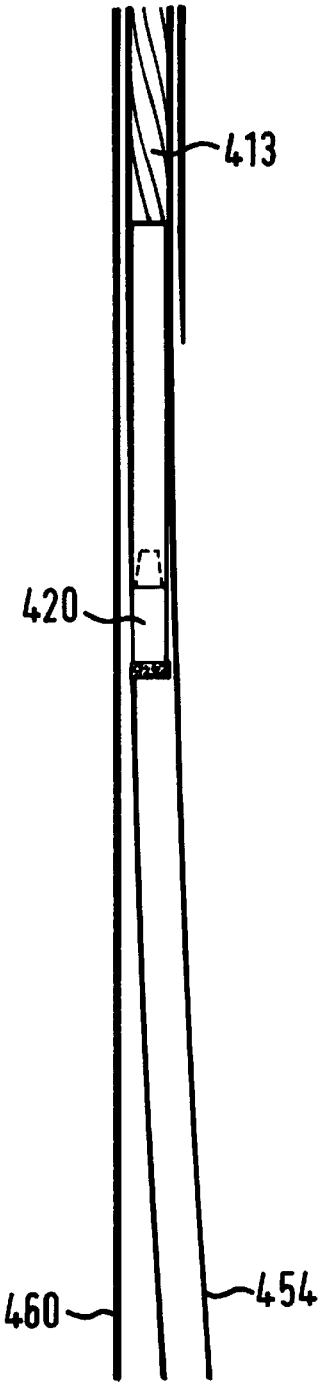
Figure 19E:
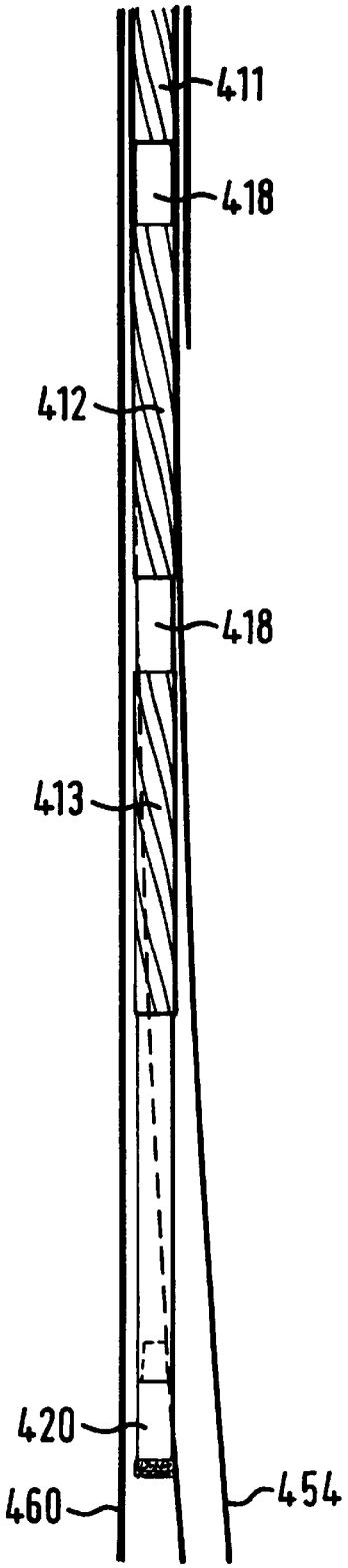

FIG. 19 shows five steps, 1–5, in a milling operation according to the present invention with a system 400 as shown in FIG. 17. In step 1, (see enlarged portion in FIG. 19B) the system 400 has been introduced from the surface on a rotatable tubular string 450 with a stabilizer or cross-over sub so that the mill 420 is approaching the beginning of a bend 452 in a liner 454 which lines a lateral wellbore 456 (see FIG. 19C) extending laterally from a primary wellbore 458 cased with casing 460. The liner 454 may be made of special drift tubulars. Prior to liner installation, the whipstock is removed. The primary and lateral wellbores are shown only in FIG. 19C but are present with the system as shown in FIG. 19 and FIGS. 19A, 19B, 19D and 19E. The liner 454 in one aspect extends to a point above the top stabilizer 411 in the wellbore as shown in FIG. 19.

In step 2 (see enlarged portion in FIG. 19A) the mill 420 is lowered further and is beginning to enter the bend 452 of the liner 454 at which milling has commenced.

In step 3 (see enlarged portion in FIG. 19C) the mill 420 has been lowered so that the lower edge of the blades 432 contacts the liner 454 at the location of milling. The stabilizer 411 is still wholly within a straight portion of the liner 454. The top of liner 454 may be in any desired location, e.g. but not limited to between ten and two hundred feet above the window location to assist in holding the mill 420 against that portion of the liner 454 to be milled through and to prevent the mill 420 from entering the lateral wellbore 456.

In step 4 (see enlarged portion in FIG. 19D) in an initial cut out the mill has broken through the outer diameter of the liner and the first stabilizer has begun to move into the bend area.

In step 5 (see enlarged portion in FIG. 19E) the mill 420 has milled through the liner 454 reestablishing communication through the primary wellbore 458 from above the system 400 to below the system 400. The system 400 is then removed from the wellbore. Additional milling or reaming may be done with any suitable tool.

In certain embodiments of the particular specific embodiment of the system 400 previously described (i.e., the particular embodiment with spaces 418 about ten inches long, etc.), the distance from the bottom of the mill to the lower end of the lowest stabilizer 411 ranges between 0 and 5 feet and preferably between 0 and 4 feet; the stabilizer 413 ranges in length between 24 and 48 inches (as do the other stabilizers 411 and 412); and the length (height) of the spaces 418 ranges between 8 and 14 inches. It is preferred in certain embodiments that the system 400 be sufficiently stiff that the lower end of the mill 420 deflects no more than about 0.4 inches from the axis of the system 400 and preferably no more than about 0.3 inches from this axis.

Figure 20:
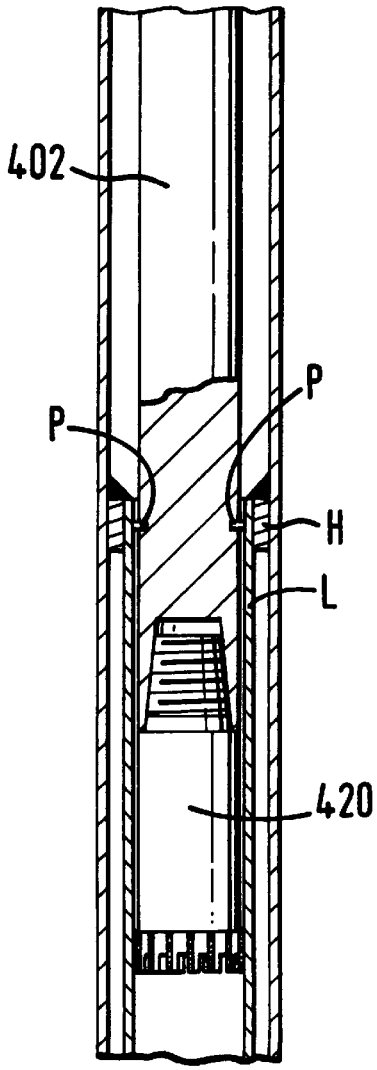
FIG. 20 is a side view in cross-section that presents an alternative embodiment of the system of FIG. 17.

FIG. 20 illustrates a "single-trip" modification for the system of FIG. 17 (and for any system disclosed herein) with which a liner L (like the liner 454, FIG. 19) is releasably suspended from the tubular 402 by a liner hanger H shear-pinned to the tubular 402 with shear pins P. The system as shown in FIG. 20 (and FIG. 17) is run into a wellbore so that the liner enters a desired lateral wellbore and is properly positioned. Then force is applied to the shear pins P to release the tubular 402 and mill 420. Rotation of the string to which the tubular 402 is attached (which string extends to earth surface) rotates the mill to mill the liner L.

Referring now to FIGS. 21A–21H and 22A and 22B, a tool 710 according to the present invention has a whipstock 720 according to the present invention with a pilot block 724 welded near a top 726 thereof. The whipstock has a concave face 722. The pilot block 724 has bolt holes 728.

The tool 710 has a starting bar 760 which has a body 762 which is secured to the whipstock 720 by bolts 769 through holes 763 extending into holes 728 in the pilot block 724. A groove 764 encircles the body 762. A stop bar 729 (see FIG. 24) extends through a stop pin hole 766.

The tool 710 has the milling apparatus 730 which includes at least one and preferably two or more mills so that a milling operation for producing a sidetracking window in casing can be accomplished in a dual or single tool trip into a cased wellbore. As shown in FIG. 21 and 22, the milling apparatus 730 includes a starting mill 740 connected to and below a hollow finishing mill 750. Interior threads 48 of the starting mill 740 engage exterior threads 758 of the finishing mill 750.

The starting mill 740 has a central channel 744 therethrough and a cutting end with carbide cutters 742. A core catcher 714 is disposed within the starting mill 740 and rests on a shoulder 747 to receive and hold debris such as an initial casing sliver, etc. The core catcher 714 is a typical two-piece core catcher.

Figures 21A, 21B:
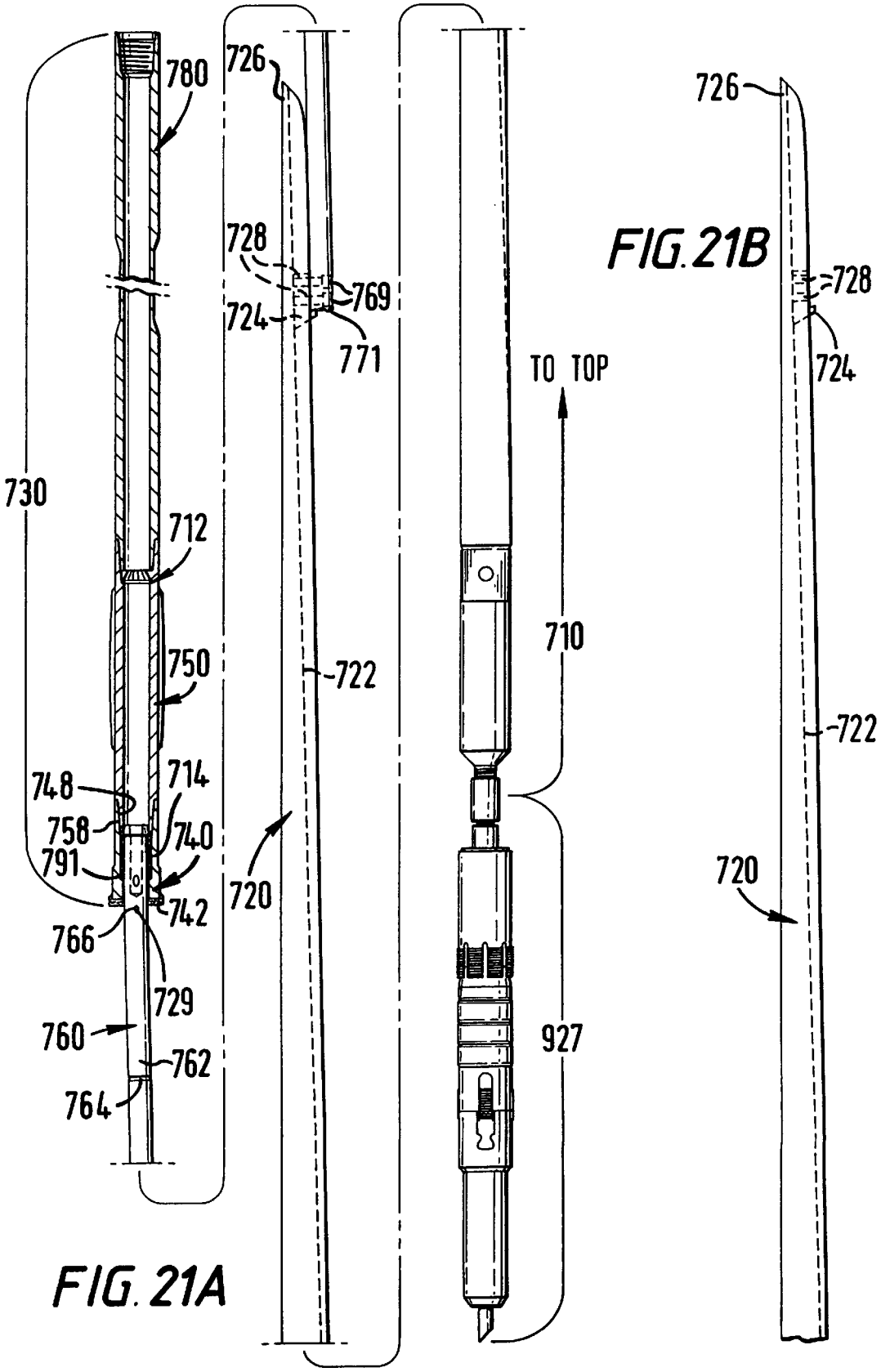
FIG. 21A–21H are side views of parts of a milling system according to the present invention.
Figures 21C, 21D, 21E, 21F, 21G, 21H:
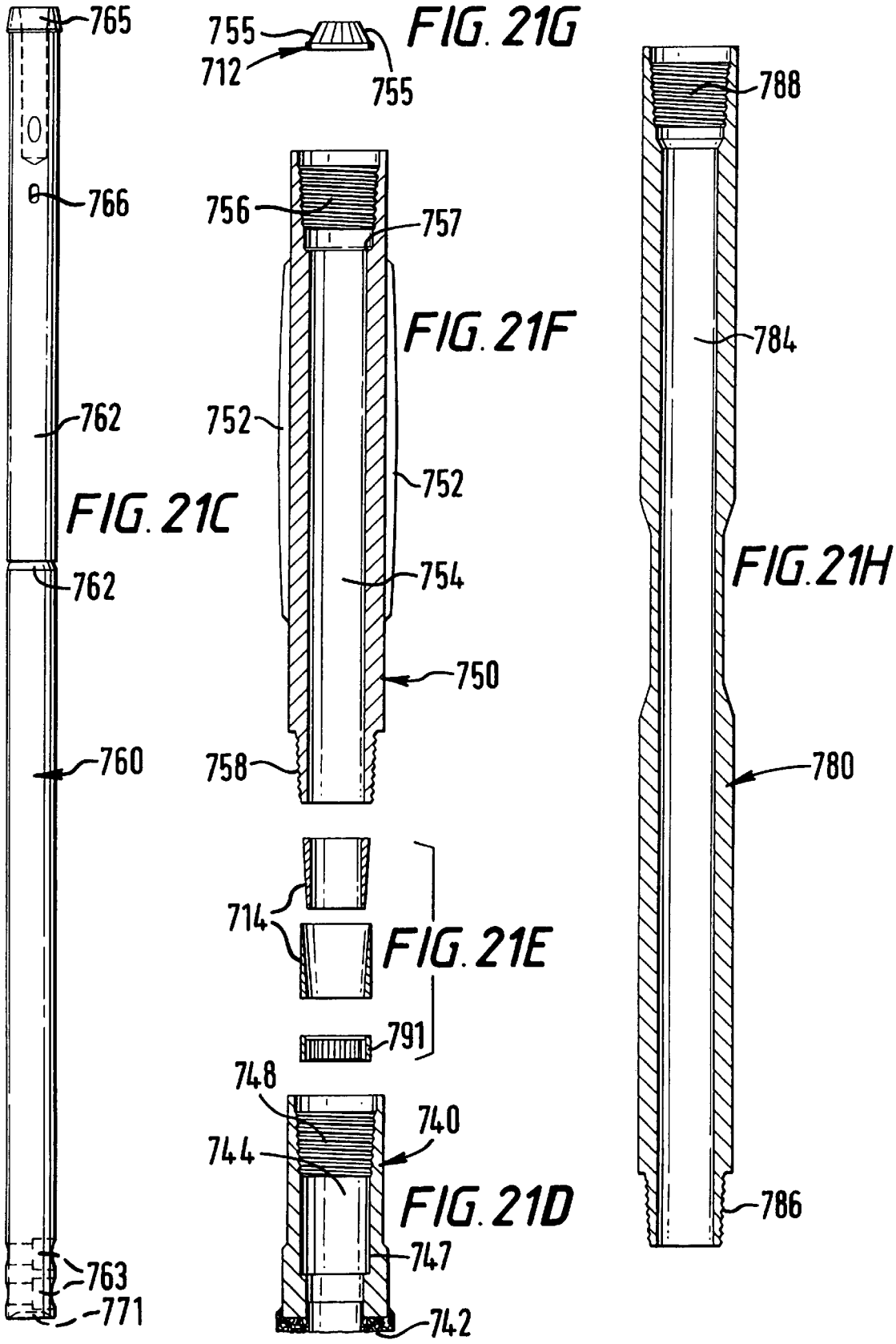
Figure 23:
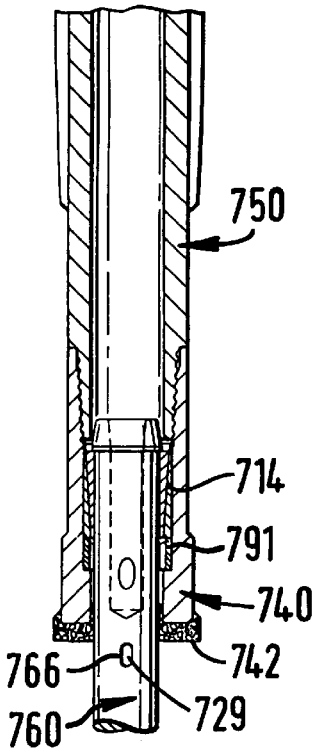
FIG. 23 is an enlarged view of part of the tool show in FIG. 22A.

The finishing mill 750 has a plurality of milling blades 752 and a central channel 754 therethrough. A retainer 712 is disposed within the channel 754 and rests on a shoulder 757 of the mill 750. The retainer 712, as shown in FIG. 21G, preferably is a spring with a plurality of fingers 755 which are disposed so that the fingers 755 protrude into the groove 764 of the starting bar 760, preventing the starting bar 760 from moving downwardly from the position shown in FIG. 24.

To accommodate a substantial portion of the starting bar 760 when its length exceeds that of the combined lengths of the mill(s), a pup joint may be used such as the pup joint 780. External threads 786 on the lower end of the pup joint 780 engage upper internal threads 756 of the finishing mill 750. Upper internal threads 788 of the pup joint engage a part of a drill string (not shown) e.g. a crossover sub with a mud motor above it. A central channel 784 extends through the pup joint and is sized and configured to receive a portion of the starting bar 760.

FIGS. 22A and 22B illustrate steps in the use of a tool 710 according to this invention. As shown in FIG. 22A, the milling apparatus 730 has a top portion 765 of the starting bar 760 within the starting mill 740 and the starting bar 760 is secured to the whipstock 720. As shown in FIG. 22B the starting mill 740 and apparatus above it have pushed down on the bar 729, breaking it, and permitting the milling apparatus 730 to receive a substantial portion of the starting bar 760. The starting mill 740 has moved to contact the pilot block 724 and mill off the bar 729.

Figure 24:
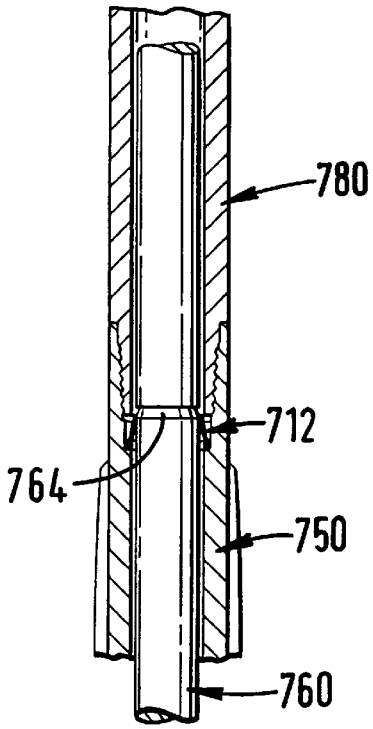
FIG. 24 is an enlarged view of a part of the tool shown in FIG. 22B.
Figure 27:
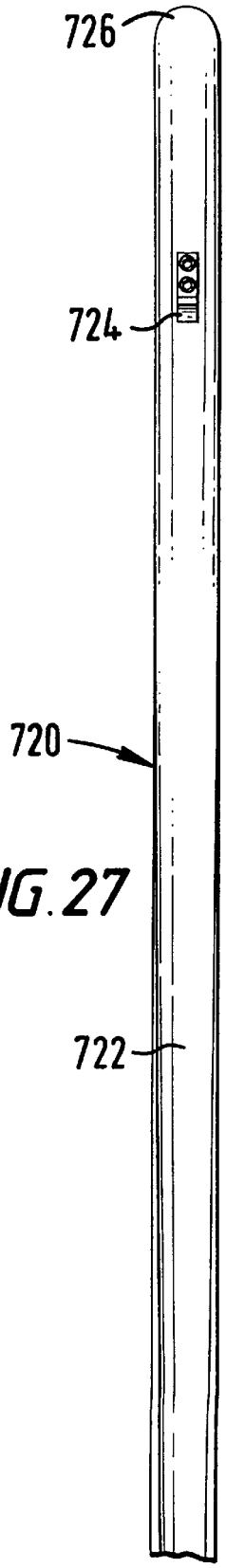
FIG. 27 is a side view of the whipstock concave member of the tool of FIG. 22A.
Figure 25:
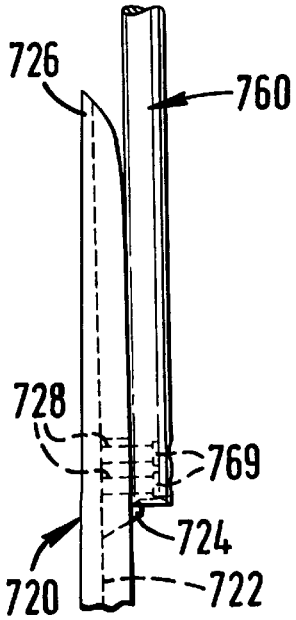
FIG. 25 is an enlarged view of a portion of the tool of FIG. 22A.
Figure 26:
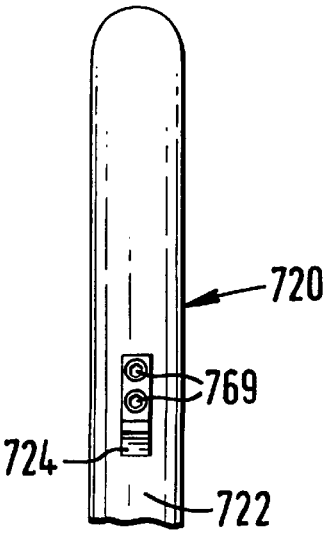
FIG. 26 is a side view of the tool as shown in FIG. 25.
Figure 28:
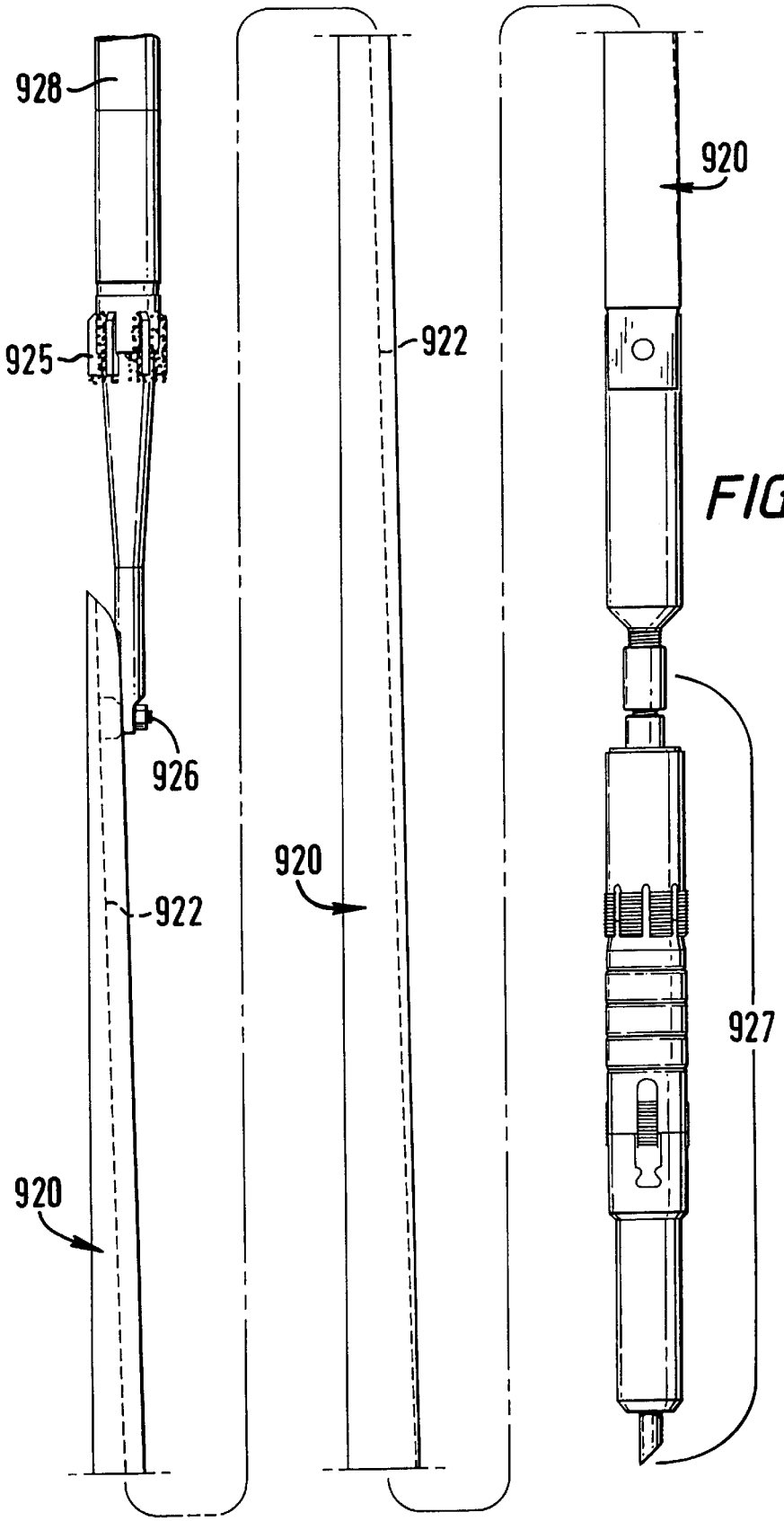
FIG. 28 is a side view of apparatus according to the present invention.

Milling now commences and the starting mill 740 mills through the pilot block 724. As the starting mill moves down the concave face of the concave member 720, the concave member 720 is moved sideways in the casing (add casing to FIGS. 22A, 22B) (to the left in FIGS. 22A and 22B) and a window is begun in the casing's interior wall. As shown in FIG. 24 the fingers 755 have entered the groove 764, preventing the starting bar 760 from falling out of the apparatus or from being pumped out by circulating well fluid. The starting bar 760 has an indented end 771 to facilitate entry of a core into the mill.

To move cutting and debris out of the wellbore a circulation fluid is, preferably, circulated downhole through the drill pipe, outside of and past the starting bar between the starting bar's exterior and the mills' interiors, past the core catcher, past a splined bearing 791, past the starting mill between its exterior and the casing's interior and back up to the surface.

As the milling apparatus mills down against the concave member, the finishing mill 750 smooths the transition from the casing edge to the wellbore to complete the milling operation. Then the milling apparatus is removed from the wellbore with the starting bar 760, casing sliver, debris, and core held within the interior of the mills.

Figure 29A:
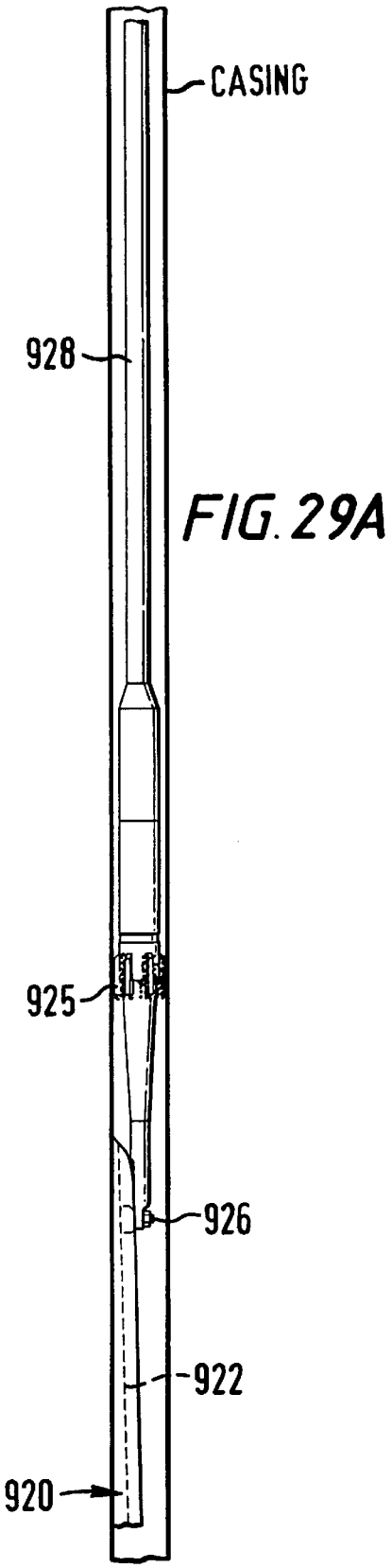
FIG. 29A is a side view of apparatus used in a method according to the present invention.
Figure 29B:
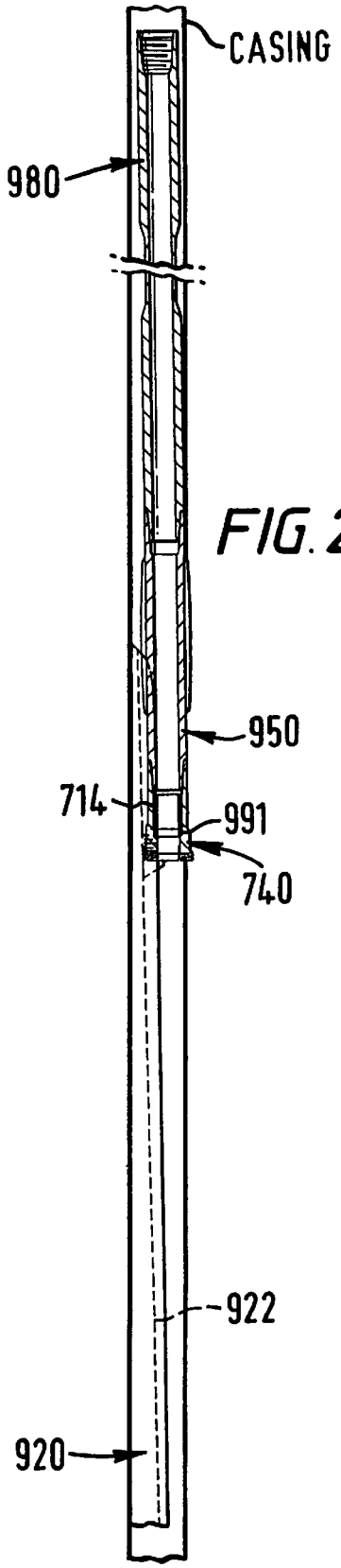
FIG. 29B is a side view of apparatus used in a method according to the present invention.

As shown in FIGS. 29A and 29B, in a two-trip milling operation according to the present invention, a tool 920 including a whipstock concave member 922 and a starting mill 925 secured thereto with a sheer stud 926 is run into a cased wellbore in which some type of anchoring-orientation device, e.g. a keyed packer (not shown), has been installed. Upon emplacement and orientation of the tool 920, the shear stud 926 is sheared by pushing down on the tool and milling is commenced producing an initial window or pocket in the casing. The tool 920 is removed leaving the whipstock concave member 922 in place and then a milling system (like the system shown in FIG. 22B) is run into the hole to continue milling at the location of the initial window or pocket. This milling system includes the items above the starting bar 760 in FIG. 22A, but not the starting bar 760; and the milling system, as shown in FIG. 29B, is used as previously described but without the starting bar. This two-trip operation results in a finished window through the casing.

Figure 30:
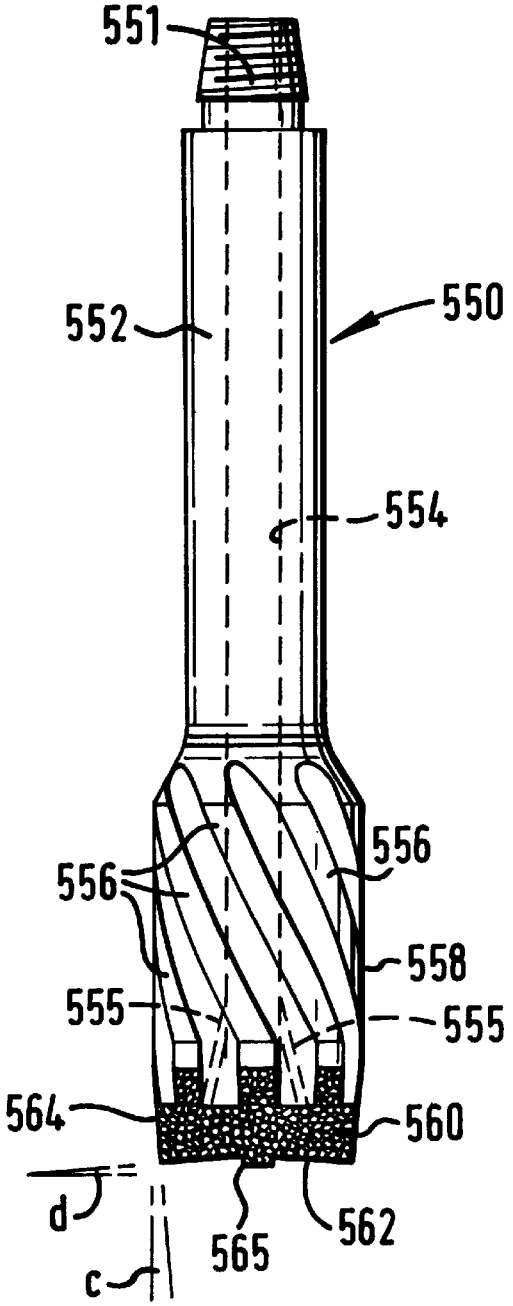
FIG. 30 is a side view of a mill according to the present invention.
Figure 31E:
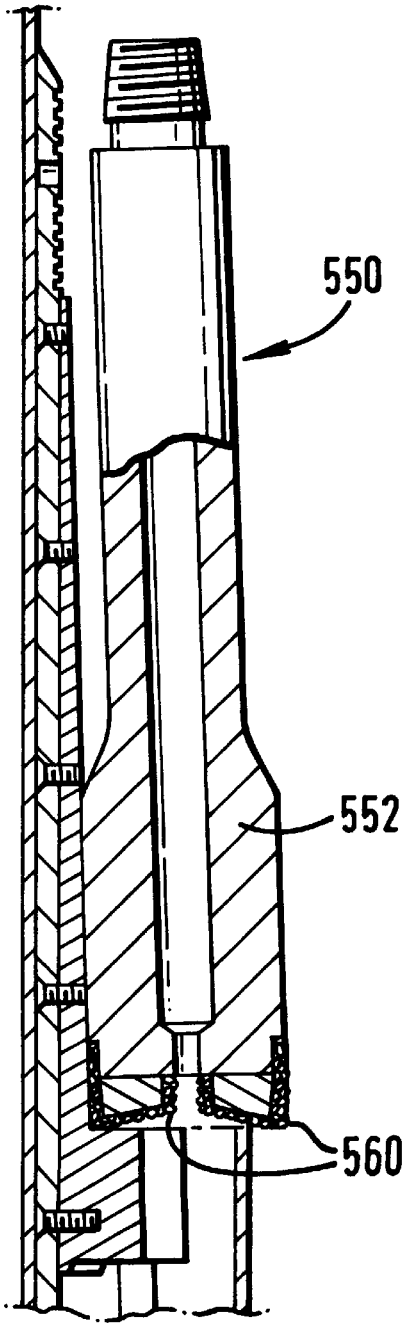
FIGS. 31A–31E show operation of a system with a mill as in FIG. 24.

FIG. 30 shows a window mill 550 for use to enlarge the window made by a mill, including but not limited to the mill 500. The window mill 550 has a body 552 with a fluid flow channel 554 from top to bottom and jet ports 555 to assist in the removal of cuttings and debris. A plurality of blades 556 present a smooth finished surface 558 for movement along a sacrificial element, along the filler in a whipstock, and/or on edges of a whipstock that define a recess with or without filler material therein. Lower ends of the blades 556 and a lower portion of the body 552 and the interior surface of the central flow bore (see FIG. 31E) are dressed with milling material 560 (e.g. but not limited to known milling matrix material and/or known milling/cutting inserts applied in any known way, in any known combination, and in any known pattern or array).

In one aspect the lower end of the body 552 tapers inwardly an angle C. In one aspect such a structure inhibits or prevents the window mill lower end from contacting and milling filler and a whipstock body as disclosed in U.S. application Ser. No. 08/752,359.

In one aspect the surface 558 is about fourteen inches long and, when used with the mill 500 having blades about two feet apart as described above, an opening of about five feet in length is formed in the casing when a sacrificial element in a whipstock (e.g. as in U.S. application Ser. No. 08/752,359) has been completely milled down. In this embodiment the window mill 550 is then used to mill down another ten to fifteen feet so that a completed opening of fifteen to twenty feet is formed, which includes a window in the casing of about eleven to fifteen feet and a milled bore into formation adjacent the casing of about five to nine feet.

In one embodiment the lower ends of the blades of the window mill body 552 taper upwardly from the outer surface toward the body center an angled (FIG. 30). This taper part tends to pull the body 552 outwardly in a direction away from filler, and away from a whipstock body (e.g. as in U.S. application Ser. No. 08/752,359) into the formation adjacent the casing, acting like a mill-directing wedge ring. Also this presents a ramp to the casing which is so inclined that mill end tends to move down and radially outward (to the right in FIG. 31E) rather than toward the whipstock.

In one method according to the present invention a mill (such as the window mill 550) mills down the whipstock, milling a window. Following completion of the desired window in the casing and removal of the window mill, a variety of sidetracking operations may be conducted through the resulting window (and, in some aspects, in and through the partial lateral wellbore milled out by the mill as it progressed out from the casing). In such a method the remaining portion of the whipstock is left in place and may, if desired be milled out so that the main original wellbore is again opened. In one aspect filler and a plug element (e.g. as in U.S. application Ser. No. 08/752,359) are milled out to provide an open passage through the whipstock.

Figure 31A:
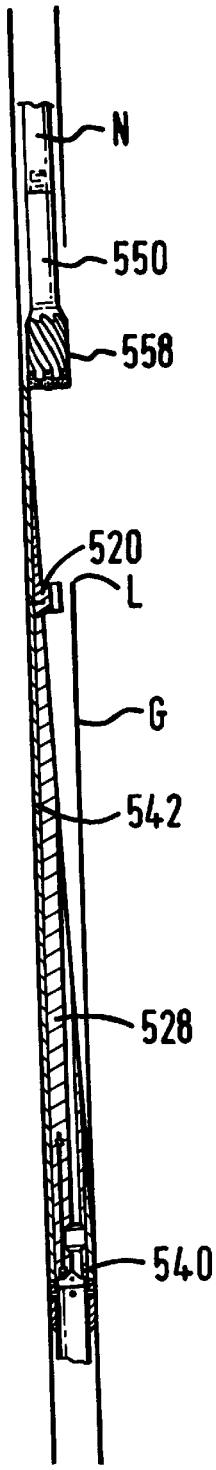

As shown in FIG. 31A, the mill 550 (FIG. 30) has been run into a wellbore (e.g. on a tubular string N of, e.g. a drill string of drill pipe to be rotated from above or to be rotated with a downhole motor as described above). The inwardly tapered portion 560 of the body 552 of the mill 550 preferably does not mill the top of a whipstock body 542 or mills it minimally.

Figure 31B:
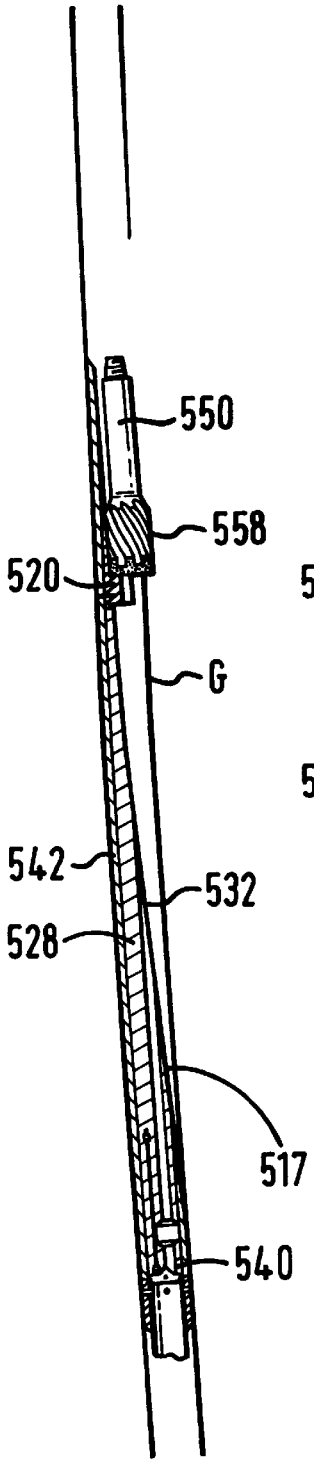
Figure 31C:
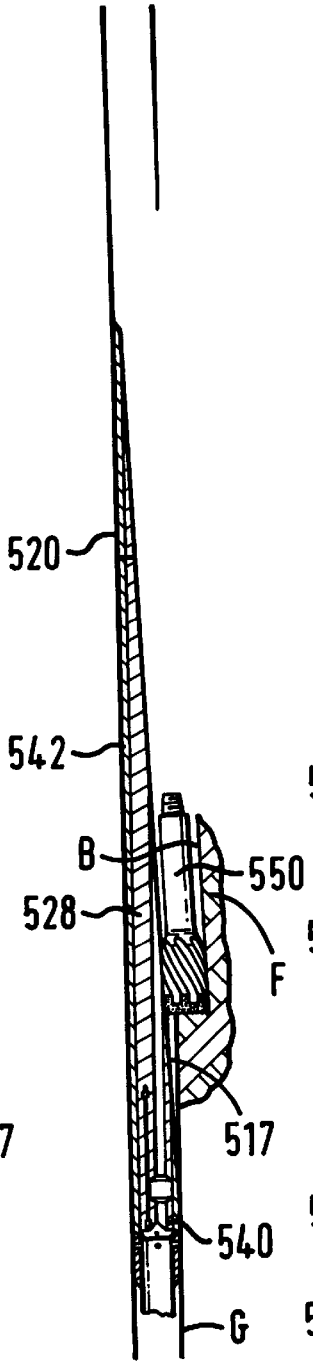

As shown in FIG. 31B the mill 550 proceeds down along the remainder of a sacrificial element 520 with the mill surface 558 holding the milling end away from the sacrificial element and directing the mill 550 away from the body 542 toward a casing G. The inwardly tapered portion of the mill 550 (tapered at angle d, FIG. 30) encounters a ledge L previously created, by e.g. a starting mill or a mill e.g. as disclosed in U.S. application No. 08/752,359, and due to the inwardly tapered portion, the mill moves outwardly with respect to the ledge L, begins to mill the casing G, and also begins to mill the remainder of the sacrificial element 520. The surface 558 will continue to co-act with the resulting milled surface on the sacrificial element 520 until the surface 558 is no longer in contact with the sacrificial element 558 as the mill 550 mills down the casing G. Thus the window, (at the point at which the mill 550 ceases contact with the sacrificial element 520) that includes the initial window previously formed by another mill and the additional portion milled by the mill 550 is created without the mills contacting the whipstock body 542 or filler 528 therein. The tubular string N is present, but not shown, in FIGS. 31B–31E. The mill 550 may be used with any known mill diverter or whipstock or in a string which is otherwise inclined or urged into contact with a tubular to be milled.

Figure 34:
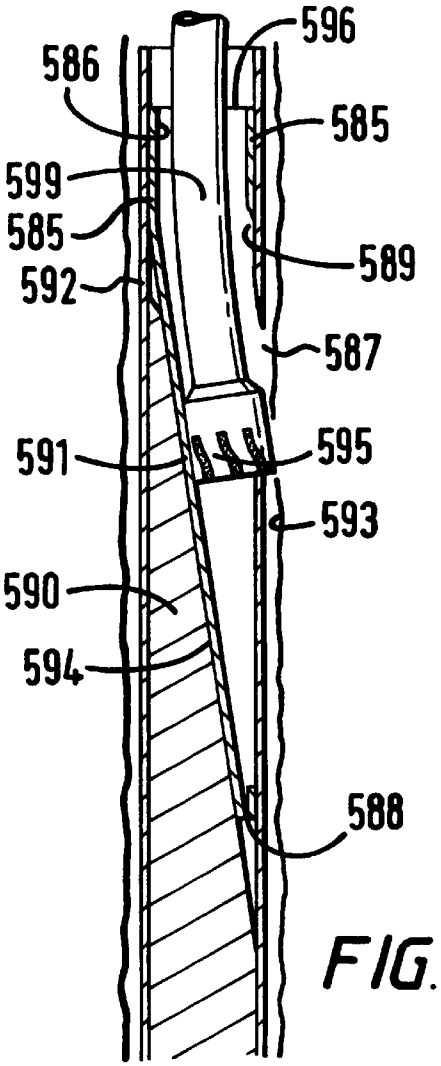
FIG. 34 is a side view, partially in cross-section of a system according to the present invention.

As shown in FIG. 34, the mill 550 has continued to mill out the window in the casing G and has both contacted the whipstock body 542 and begun to mill a bore B into the formation F (e.g. a bore suitable for sidetracking operations). In a whipstock in which side rails define sides of a recess in the whipstock, as in U.S. application Ser. No. 08/752,359, preferably the surface 558 of the mill 550 is contoured, configured and shaped to correspond to a curved shape presented by the rails so that these parts of the body 542 have more than point contact and effectively direct the mill 550 away from the whipstock. A radiused face 532 of the whipstock body 542 and filler 528 also assists in directing the mill 550 at a desired angle away from the whipstock. Eventually the mill 550 contacts a straight (non-radiused) face 517 of the whipstock body and filler material 528.

Figure 31D:
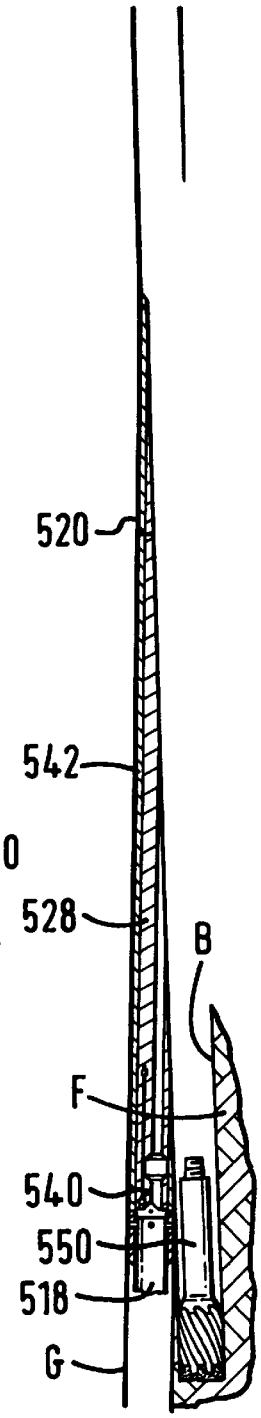

As shown in FIG. 31D the mill 550 has milled completely through the casing G and has extended the bore B down beyond a plug element 540 and a sub 518. Further milling may be conducted with the mill 550 or other mills, or the mill 550 may be withdrawn from the wellbore.

Figure 32B:
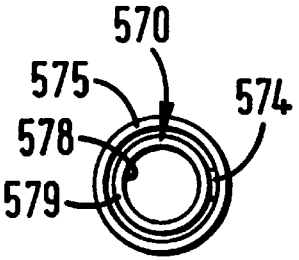
FIG. 32B is a top end cross-sectional view of the mill guide and casing of FIG. 32A.
Figure 32A:
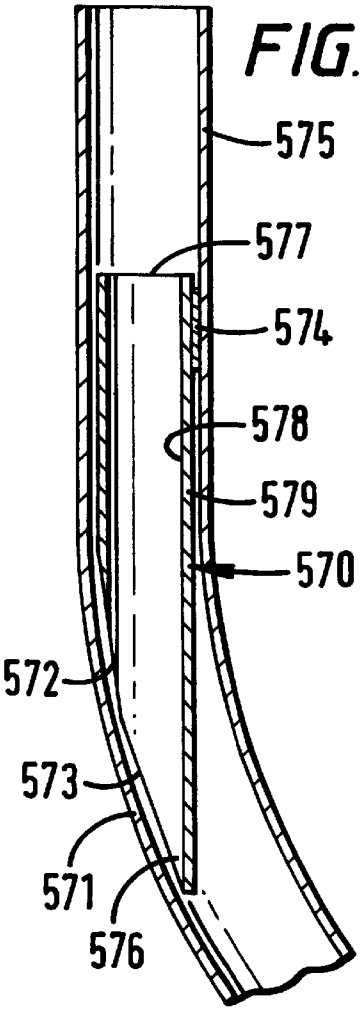
FIG. 32A is a side view in cross-section of a mill guide according to the present invention anchored in a wellbore casing.

FIGS. 32A and 32B show a mill guide 570 according to the present invention with a hollow cylindrical body 579 having a bore 578 therethrough, an open top end 577 and an open bottom end 576. The mill guide 570 is disposed in a piece of casing 575 which is part of a string of casing (not shown) in a wellbore in the earth. An anchor 574 (or anchors) holds the mill guide 570 in place at a desired location in the casing with an opening 573 of the mill guide's bottom end 576 disposed and oriented so that a mill passing through the mill guide 570 will mill a desired area of the casing, creating a desired hole, slot, opening, or window. The bottom end 576 of the mill guide 570 is formed or cut to have a desired shape 572. This shape 572 may be made to correspond to a curved portion 571 of the casing 575.

Figure 33:
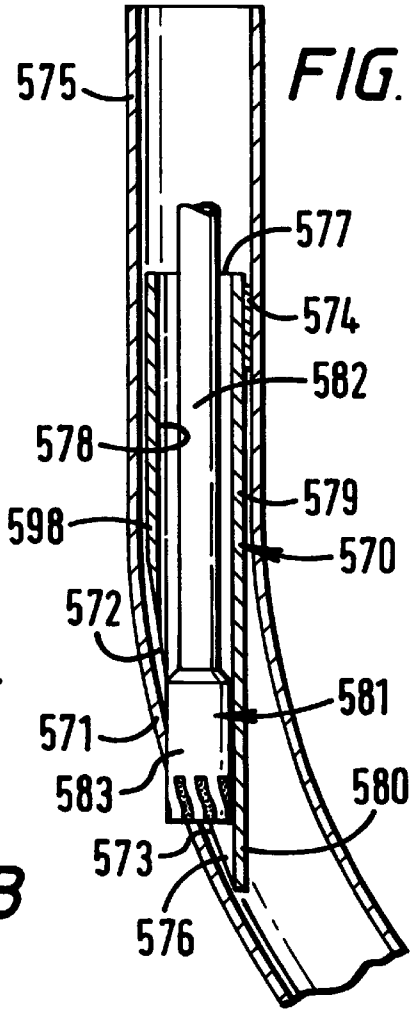
FIG. 33 is a side view of the system of FIG. 32A including a milling apparatus.

As shown in FIG. 33, a mill 581 on a string of drill pipe 582 has been introduced through the casing 575 and the mill guide 570 to contact the casing 575 and begin to mill a hole therethrough. A body 583 of the mill 581 has a length such that at least about a fourth of the desired opening is milled (and in other aspects substantially all of the desired opening) while the mill body 583 remains in contact with a side 580 of the bottom end 576 of the mill guide 570, thus providing a continuous reaction support during part or substantially all of the milling. The side 580 may be the same thickness as a side 598 which is shorter than the side 580; or the side 580 may be thicker than the side 598. The interior of the side 580 may one or more additional layers of material thereon. Such material may also inhibit the mill from milling the side 580. This additional material may be any desired practical thickness and may be any known suitable material, including, but not limited to, steel, carbide steel, stainless steel, known alloys, and hardfacing material. Such a layer or layers may be added by any known method (e.g., welding or hardfacing) or may be formed integrally of the side 580.

FIG. 34 shows a mill guide 585 with a hollow body 586, a top open end 596, a bottom end point 88, a side opening 589, and a slanted side member 591. A whipstock 590 disposed in a casing 592 in a wellbore 593 has a concave surface 594 which corresponds to the shape of the slanted side member 591. The mill guide 585 is made of a strong metal, e.g. steel, so that the slanted side member 591 protects the concave surface 594 from the effects of a mill 595 on flexible pipe 599. The whipstock 590 and the side opening 589 are positioned so that a window 587 is cut at a desired location on the casing 582. As shown in FIG. 34 the window 587 has only been partially milled and will be completed as the mill 595 moves down the slanted side member 591. It is within the scope of this invention for the mill guide 585 and the whipstock 590 to be connected together; to be formed integrally as one member; or for the mill guide 585 to be releasably connected to the whipstock (e.g. but not limited to, by one or more shear studs or shear lugs). In another aspect the mill guide and the whipstock are installed separately. The mills in FIGS. 33 and 34 may be the mill 550 (FIG. 30).

Figure 35A:
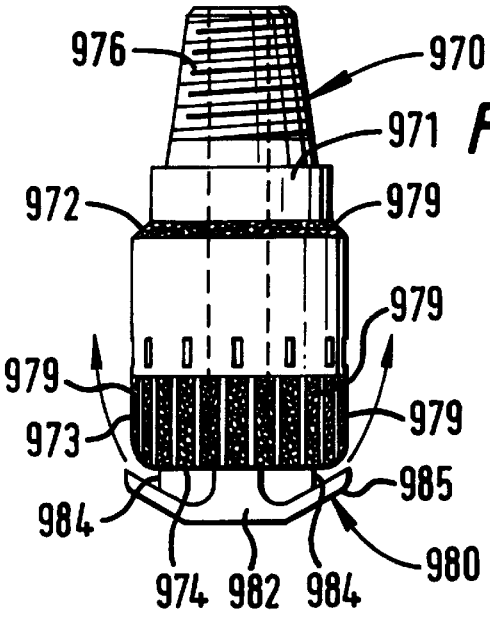
FIG. 35A is a side view of a milling tool according to the present invention with a bottom flow director in cross-section.
Figure 35B:
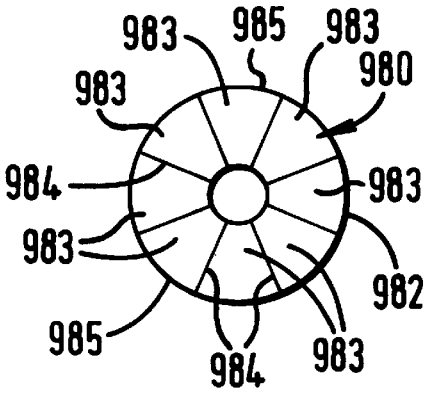
FIG. 35B is a top plan view of the flow director of the tool of FIG. 35A.

FIG. 35A shows a milling tool 970 according to the present invention which has a tool body 971 with a shoulder 972 and lower milling head 973. The tool 970 has fluid flow ports and a central channel. A flow director 980 (FIGS. 35A and 35B) is secured to a bottom end 974 of the tool body 971 (secured e.g. by epoxy, screws, and/or bolts; bolts and screws are preferably disposed off-center with respect to the flow director 980 and off-center and away from the central flow channel through the tool body). As shown in FIG. 35B the flow director has a body 982 and a series of flow directing chambers 983 defined by side walls 984 and an upturned lip or end wall 985. One chamber corresponds to each flow port and exit opening. It is within the scope of this invention to eliminate the side walls 984. An upper threaded end 976 provides for threaded engagement of the tool 970 with other connectors or tools. Arrows indicate fluid flow direction. Milling elements 979 (e.g. but not limited to diamond milling elements which work more effectively when cooled by the flowing fluid) are on the circumferential side surface of the lower milling head 973, on the shoulder 972 and on the bottom end 974. The curved corner shaped of the flow director 980 facilitates co-action of a milling tool with a concave surface of a whipstock's concave member. With a flow director made of aluminum or plastic, such a flow director can be easily worn away by a formation after a side milling operation is completed to expose milling elements on the lower end of the tool body.

Figure 36A:
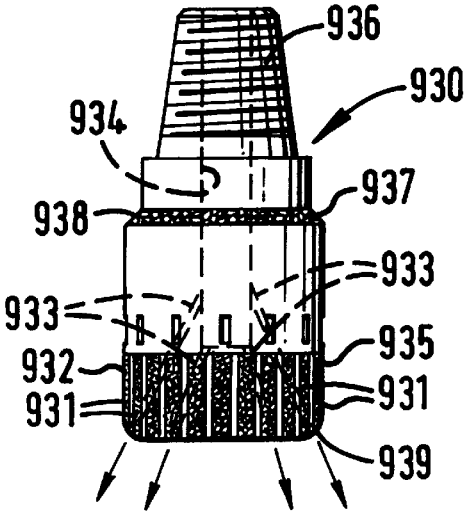
FIG. 36A is a side view of a milling tool according to the present invention.
Figure 36B:
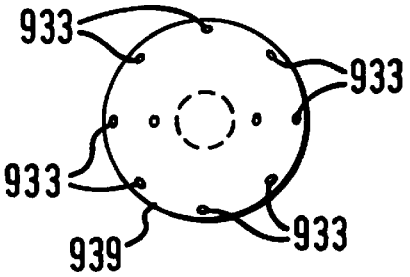
FIG. 36B is a bottom end view of the milling tool of FIG. 36A.
Figure 37:
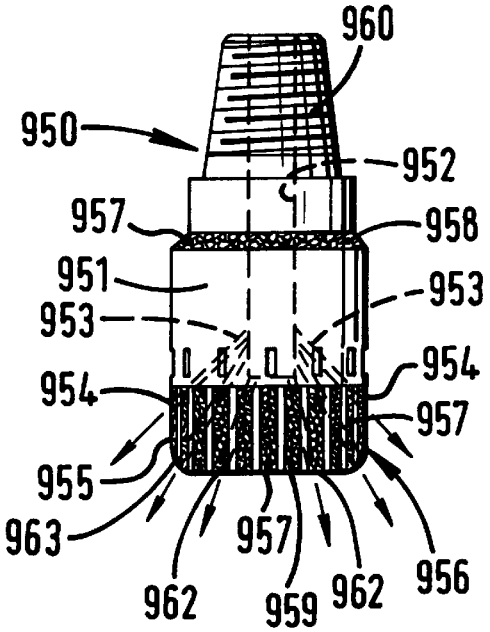
FIG. 37 is a side view of a milling tool according to the present invention.

FIG. 37 shows a mill 950 according to the present invention with a mill body 951 having a central circulating fluid flow channel 952 therethrough which communicates with a plurality (one or more) side fluid flow ports 953 each having an exit opening 954 on a circumferential side surface 955 of a mill head 956. A plurality of milling elements 957 are on the side of the tool and on an upper shoulder 958 and lower end 959. A top end 960 of the mill 950 is threaded. This tool may also have one or more fluid flow ports 962 with an exit opening at a lower corner 963 of the mill head 956 (like those of the tool in FIG. 36A).

FIG. 36A shows a mill 930 with a head 935 with milling elements 931 on a side circumferential surface 932 thereof. Such elements may also be used on the bottom end of the tool. A plurality of fluid flow ports 933 communicate with a central fluid flow channel 934 through the mill 930 to provide fluid to exit at bottom end corners 939 on the mill 930 to cool the elements 931. The mill 930 has an upper threaded end 936 for interconnection with other wellbore apparatuses. Milling material and/or elements 937 may be provided on an upper shoulder 938 of the mill 930.

Figures 38A, 38B, 38C, 39, 40:
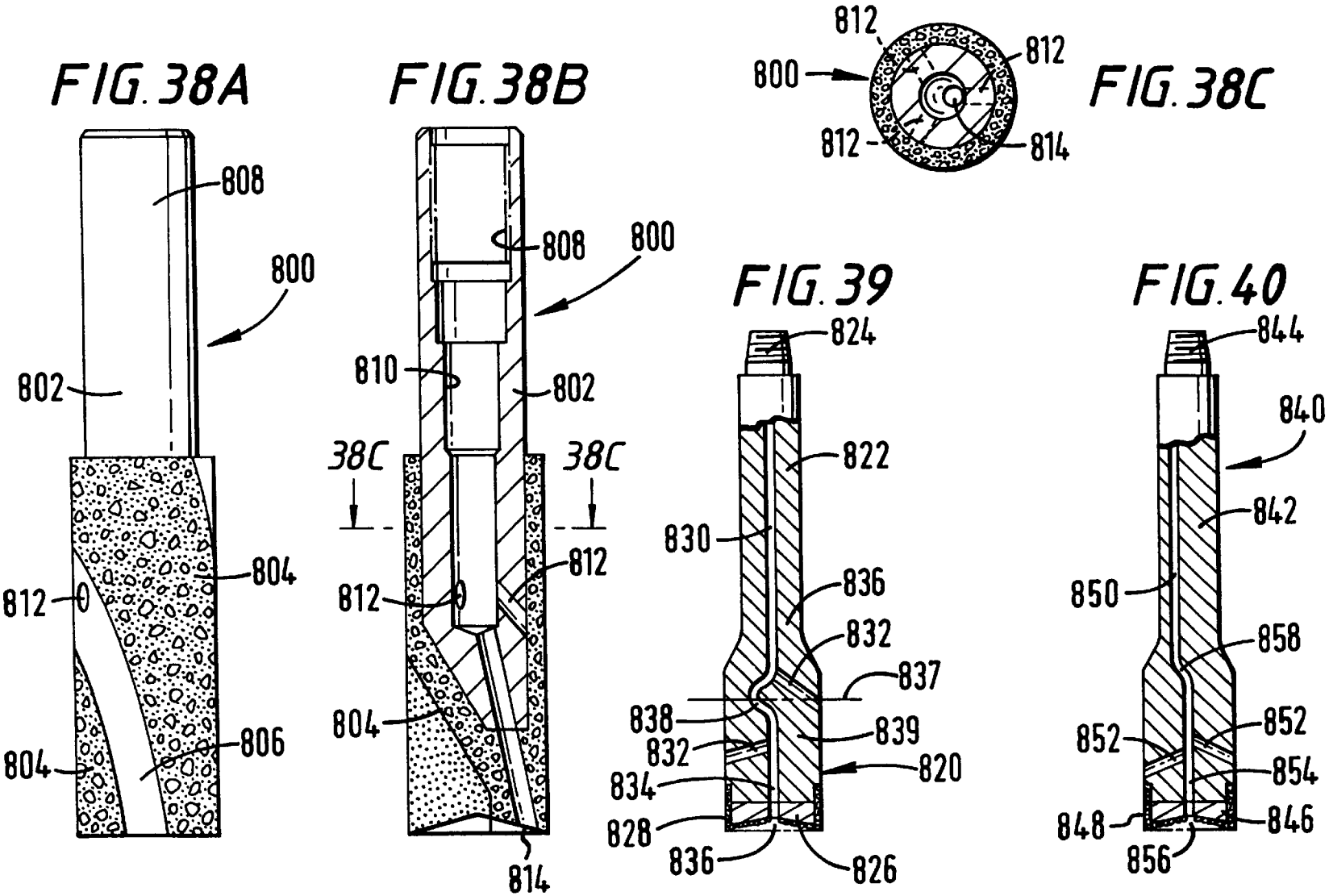
FIG. 38A is a side view of a mill according to the present invention.
FIGS. 38B and 38C are cross-section views of the mill of FIG. 38A.
FIG. 39 is a side view in cross section of a mill according to the present invention.
FIGS. 40–47 are side views in cross section of a mill according to the present invention.

FIGS. 38A–38C show a mill 800 according to the present invention which has a body 802, milling blades or surfaces 804, and fluid courses 806 between the surfaces 804. An upper internally threaded end 808 provides for releasable connection to a workstring of pipe or coiled tubing.

A central bore 810 extends from a top of the body 802 downwardly and is intersected by fluid bores 812 that provide a path for fluid to exit the body to flush milled cuttings and debris up and away from the mill and by a fluid flow bore 814 that extends from a lower end of the central bore 310 down to the lowest end of the body 802. A core that begins to core the mill may enter the bore 814 at some point above the lower end of the mill.

The surfaces 804, the lower end of the body 802, and the interior surface of at least a lower portion of the bore 814 may be dressed with milling material, e.g. but not limited to milling inserts and/or crushed tungsten carbide matrix milling material. By using such material in the bore 814 the separation of a core from a tubular being milled is facilitated. It is also within the scope of this invention to dress the upper end of the bore 814 or the whole bore 814 and/or the lower end of the central bore 810 with such material.

The bore 814 (and the bores in the other embodiments disclosed herein) may have an inner diameter sized in relation to a core that will be produced by milling with the mill 800 (or with the mills in the other embodiments). In one aspect, the bore diameter is slightly larger than the wall thickness of the tubular being milled. In another aspect the bore diameter is significantly larger than the width of a core being produced by milling so the core does not impede washing fluid flow out from the core bore and, in such a case, one or more fluid flow bores like the bores 812 may be optional.

As shown in FIG. 38B, it is preferred that there be a bend at some point in the compound bore 810–814 or that the bore 814 meet the bore 810 at an angle so that a top core end proceeding to the bend or angle (or into the angled portion of a bore like the bore 814 itself) is held and more easily twisted away from a tubular being milled, thus inhibiting or preventing damaging "coring" of the mill by a core that moves unimpeded up into a mill's inner body. Such coring can result in a cessation of milling and/or in the production of a relatively large core that is difficult to manipulate and remove, particularly if it drops from the mill's interior and falls down into the wellbore.

FIG. 39 shows a mill 820 according to the present invention with a body 822 having a threaded top end 824; a lower end 826 dressed with milling material 828; a top flow bore 830 extending from the top of the body 822 downwardly; washing fluid channels 832 in fluid communication with the bore 830 and the space outside the mill 820; a core bore 834 extending up from a lower opening 836; and a twist bore 838 interposed between and in fluid communication with the top flow bore 830 and the core bore 834. As with the bend between the bores 810–814 (FIG. 38B), the twist bore facilitates holding of a top core end and separation of a core from a tubular being milled. As shown the bores have essentially the same inner diameter, but it is within the scope of this invention for all three diameters to be different; for the twist bore to be larger or smaller in inner diameter than the other two bores; for any two of the bores to have a similar inner diameter; and, in one aspect, for the core bore to be slightly larger than the width of a core to be produced and for the twist bore and/or top bore to be larger or smaller in inner diameter than the core bore (all as with all multi-bore mill embodiments disclosed herein); and, depending on the core bore diameter, the washing fluid channels (at least one, two, or three in certain embodiments) are optional for all multi-bore mill embodiments herein. In cross-section the bore 830 is essentially in the center of a cylindrically shaped body 822, as is the bore 834 in a lower cylindrical bottom piece 839.

It is within the scope of this invention to employ any bend angle between two bore portions (e.g. as with the top and core bores of FIG. 38B) and/or to use any bent, twisted, curved, helical, or undulating intermediate bore to receive and hold a core top end to facilitate the core's separation from a tubular being milled. Such an intermediate bore itself may include a plurality of sub-bores at angles to each other.

For ease of manufacture, shipping, and/or assembly any mill disclosed herein may be made of multiple pieces that are threaded together, welded together, or otherwise secured together for use. For example the mill 820 may be made of two pieces, shown schematically as a top piece 836 above a line 837 (FIG. 39) and a bottom piece 839 below the line 837. Appropriate threading, in certain embodiments, is used with extensions for the threads if needed.

FIG. 40 shows a mill 840 according to the present invention with a cylindrical body 842 having a threaded top end 844; a lower end 846 dressed with milling material 848; a top flow bore 850 (off center in the body 842) extending from the top of the body 842 downwardly; washing fluid channels 852 in fluid communication with the bore 850 and the space outside the mill 840; a core bore 854 (essentially centered in the body) extending up from a lower opening 856; and a twist bore 858 interposed at an angle between and in fluid communication with the top flow bore 850 and the core bore 854. As with the bend between the bores 810–814 (FIG. 38B), the twist bore facilitates holding of a top core end and separation of a core from a tubular being milled. In the mill 840, the top bore 850 is offset from a center of the body 842 and the core bore is essentially at the center. These positions may be reversed.

Figure 41:
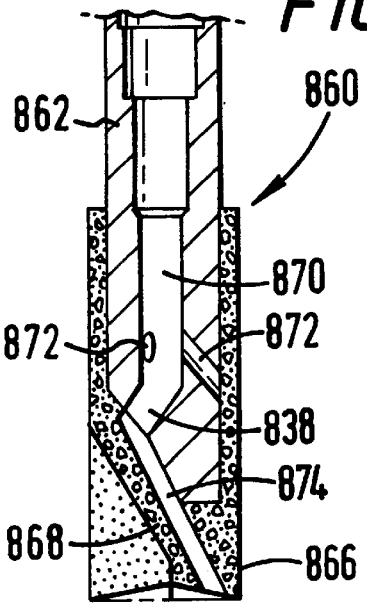

FIG. 41 shows a mill 860 (similar to the mill 800) according to the present invention with a body 862 having a threaded top end (not shown); a lower end 866 dressed with milling material 868; a top flow bore 870 extending from the top of the body 862 downwardly; washing fluid channels 872 in fluid communication with the bore 870 and the space outside the mill 860; a core/fluid bore 874 extending up from a lower opening 876; and a twist bore 838 interposed between and in fluid communication with the top flow bore 870 and the core bore 874. As with the bend between the bores 810-814 (FIG. 38B), the twist bore facilitates holding of a top core end and separation of a core from a tubular being milled. If a core does not move up to the twist bore, the angle of the core/fluid bore 874 alone facilitates core separation.

Figure 42:
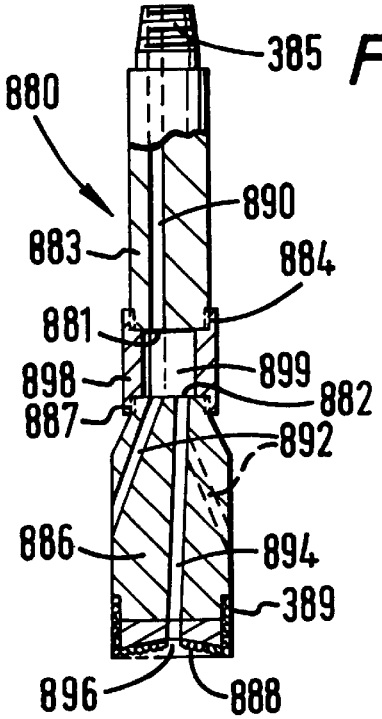

FIG. 42 shows a mill 880 according to the present invention having a cylindrical threaded top part 883 with a bottom threaded end 884 and a top threaded end 885; a lower part 886 with a top threaded end 887 and a bottom end 889 dressed with milling material 888; a top flow bore 890 (off center) in the top part 883 extending downwardly at an angle from center; washing fluid channels 892 in fluid communication with a core bore 894 and the space outside the mill 880; the core bore 894 extending at an angle from a longitudinal axis of the lower part 886 up from a lower opening 896 to a top end of the lower part 886; and a hollow coupling 898 interposed between and in fluid communication with the top flow bore 890 and the core bore 894.

The hollow coupling 898 has a fluid bore 899 therethrough that is in fluid communication with the top flow bore 890 and the core bore 894. The coupling 898 and parts 883 and 886 may be marked exteriorly so that upon connection a top opening 882 of the core bore is mis-aligned with a bottom opening 881 of the top flow bore 890 so that entry is inhibited or prevented of a top end of a core passing up through the coupling 898 into the bottom opening 881. A coupling such as the coupling 898 (with either exterior or interior threads, or one type on one end and the other type on the other end) may be used with any mill disclosed herein and any such mill may be made up with a top part and bottom part as is the mill 880. A line (as the line 837, FIG. 39) separating two such mill pieces can be positioned through a twist or bent bore or either above such a bore or below it for any embodiment herein.

Figure 43:
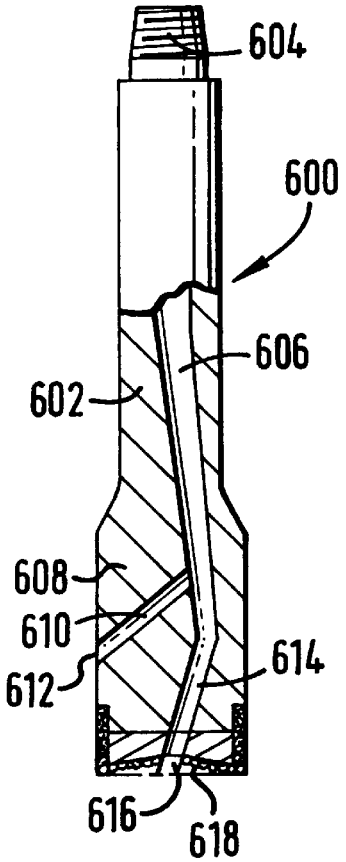

FIG. 43 shows a mill 600 with a cylindrical mill body 602 and a top threaded end 604. A flushing fluid flow channel 606 extends from the top of the body down into a broader cylindrical part 608 of the body where it branches into a side fluid flow channel 610 having a side exit 612 and a core channel 614 that extends down to a bottom center opening 616. The core channel 614 is disposed and sized for receiving a core of material formed when the mill 600 mills an opening in a tubular in a wellbore in the earth. Preferably the core channel 614 is offset with respect to the flushing fluid flow channel and, in one aspect, the core channel 614 is at an angle to a longitudinal axis of the mill body 602. Matrix milling material 618 and/or milling inserts (e.g. of tungsten carbide) is applied to an interior surface at the lower end of the core channel 614 to facilitate separation of a core entering into the core channel from a tubular being milled.

Figure 44:
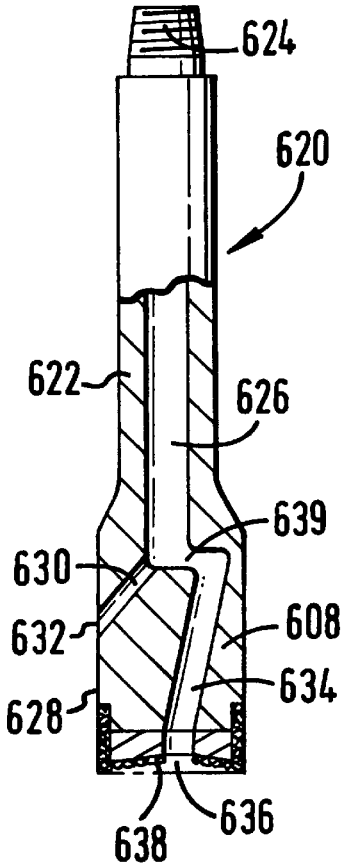

FIG. 44 shows a mill 620 with a cylindrical mill body 622 and a top threaded end 624. A flushing fluid flow channel 626 extends from the top of the body down into a broader part 628 of the body where it branches into a side fluid flow channel 630 having a side exit 632 and a core channel 634 that extends down to a bottom center opening 636. The core channel 634 is disposed and sized for receiving a core of material formed when the mill 620 mills an opening in a tubular in a wellbore in the earth. Preferably the core channel 634 is offset with respect to the flushing fluid flow channel and, in one aspect, the core channel 634 is at an angle to a longitudinal axis of the mill body 622. A short horizontal intermediate flow channel 639 interconnects the flushing fluid flow channel 626 and the core channel 634. Matrix milling material 638 and/or milling inserts (e.g. of tungsten carbide) is applied to an interior surface at the lower end of the core channel 634 to facilitate separation of a core entering into the core channel from a tubular being milled. As with other embodiments, such milling material may be used on all or any part of the bore to facilitate core separation and/or milling of a core.

Figure 45:
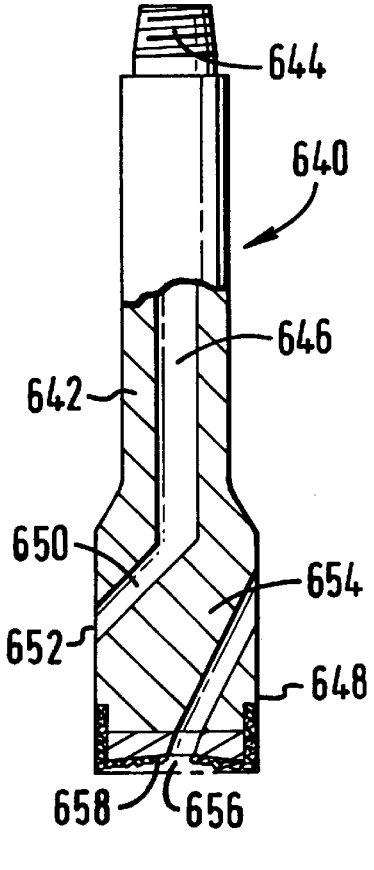

FIG. 45 shows a mill 640 with a cylindrical mill body 642 and a top threaded end 644. A flushing fluid flow channel 646 extends from the top of the body down into a broader part 648 of the body where it continues into a side fluid flow channel 650 having a side exit 652 and a core channel 654 that extends down to a bottom center opening 656. The core channel 654 is disposed and sized for receiving a core of material formed when the mill 640 mills an opening in a tubular in a wellbore in the earth. Preferably the core channel 654 is offset with respect to the flushing fluid flow channel and, in one aspect, the core channel 654 is at an angle to a longitudinal axis of the mill body 642. The side exit fluid flow channel 652 may exit at any desired point on the side of the mill body or at an opening on the mill body bottom (as may any flushing channel herein). Matrix milling material 658 and/or milling inserts (e.g. of tungsten carbide) is applied to an interior surface at the lower end of the core channel 654 to facilitate separation of a core entering into the core channel from a tubular being milled.

Figure 46:
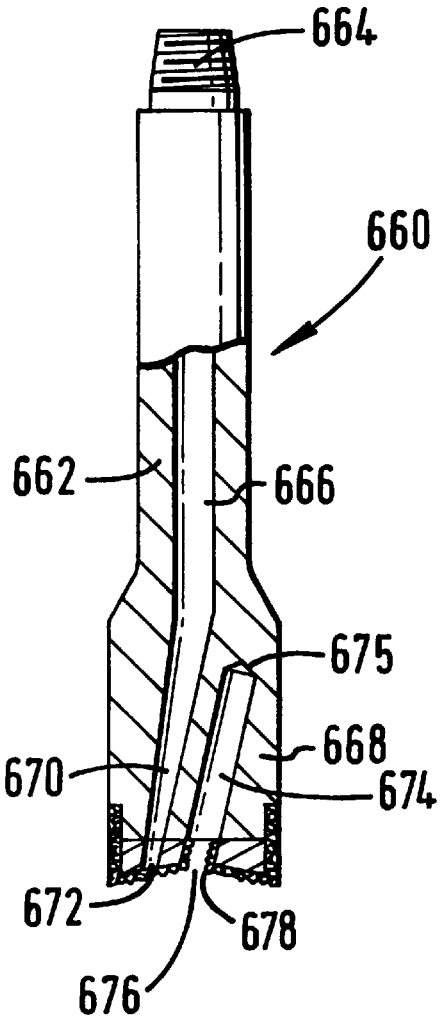

FIG. 46 shows a mill 660 with a cylindrical mill body 662 and a top threaded end 664. A flushing fluid flow channel 666 extends from the top of the body down into a broader part 668 of the body where it continues into a lower fluid flow channel 670 having a bottom exit 672. A core channel 674 extends up from the bottom of the body 662 from an opening 676. The core channel 674 is disposed and sized for receiving a core of material formed when the mill 660 mills an opening in a tubular in a wellbore in the earth. Preferably the core channel 474 is offset with respect to the flushing fluid flow channel and, in one aspect, the core channel 474 is at an angle to a longitudinal axis of the mill body 462. The core channel 474 ends at a top end thereof 475 which a core will abut and beyond which a core will not move. Matrix milling material 478 and/or milling inserts (e.g. of tungsten carbide) is applied to an interior surface at the lower end of the core channel 474 to facilitate separation of a core entering into the core channel from a tubular being milled.

Figure 47:
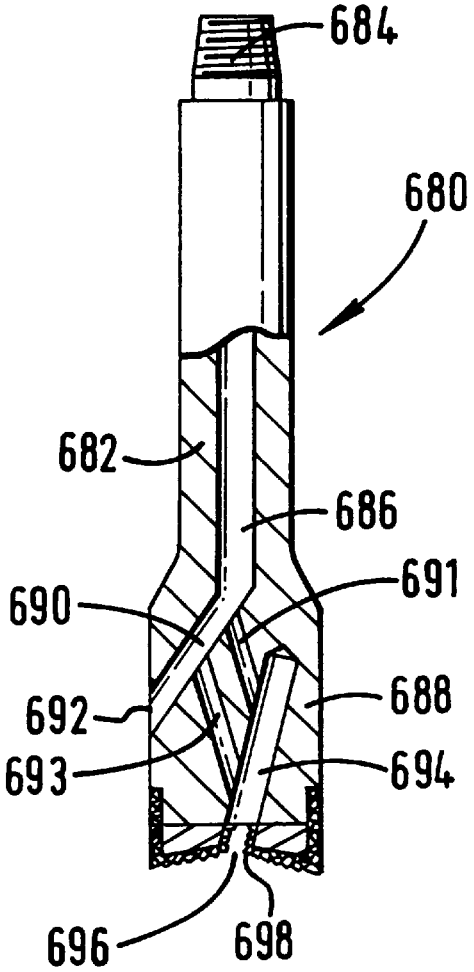

FIG. 47 shows a mill 680 with a mill body 602 and a top threaded end 684. A flushing fluid flow channel 686 extends from the top of the body down into a broader part 688 of the body where it branches into a side fluid flow channel 690 having a side exit 692 and intermediate flow channels 691 and 693 that intercommunicate with a core channel 694 that extends down to a bottom center opening 696. The core channel 694 is disposed and sized for receiving a core of material formed when the mill 600 mills an opening in a tubular in a wellbore in the earth. Preferably the core channel 694 is offset with respect to the flushing fluid flow channel and, in one aspect, the core channel 694 is at an angle to a longitudinal axis of the mill body 682. Matrix milling material 698 and/or milling inserts (e.g. of tungsten carbide) is applied to an interior surface at the lower end of the core channel 494 to facilitate separation of a core entering into the core channel from a tubular being milled. In one aspect the channels 491 and 493 are sized so that a core will not enter them. As with the mill of FIG. 19, any mill described herein may be made of two or more interconnectible pieces. In one aspect such a multipiece design facilitates creation of the various interior channels.

Figure 48:
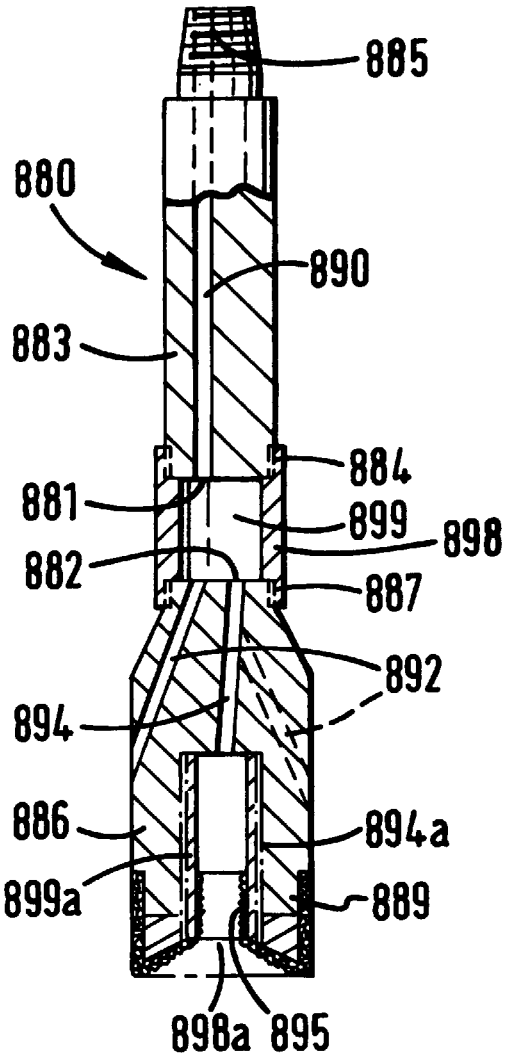
FIG. 48 is a side view in cross section of a mill according to the present invention.
Figure 49A:
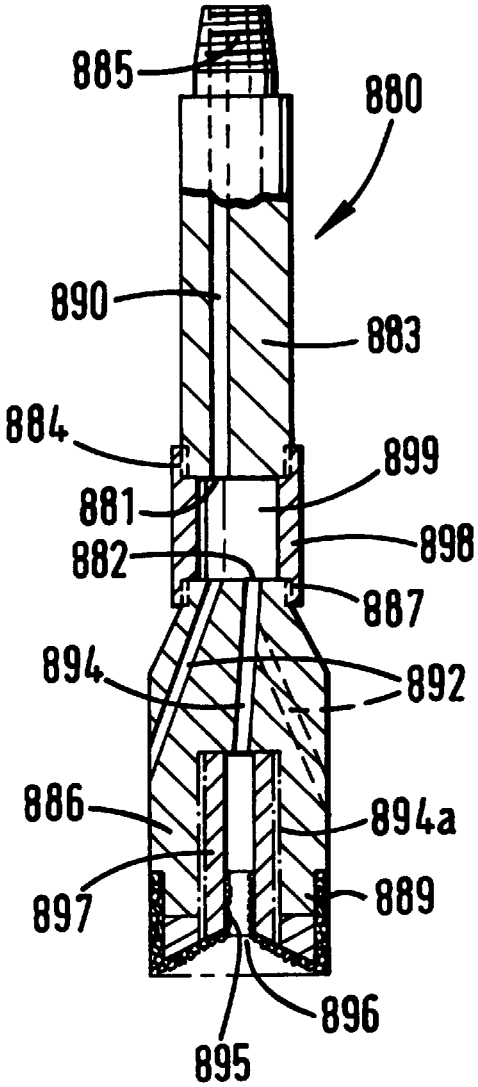
FIG. 49A is a side view in cross section of a mill according to the present invention.
Figure 49B:
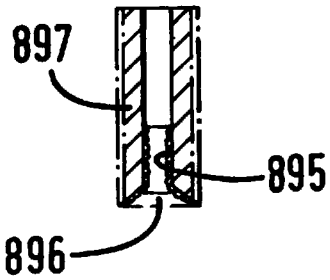
FIG. 49B is a side view in cross section of a core bore insert according to the present invention which is shown in the mill in FIG. 49A.
Figure 49C:
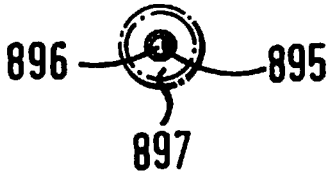
FIG. 49C is a top view of the core bore insert of FIG. 49B.

FIGS. 48 and 49A show variations of the mill 880 of FIG. 42.

FIG. 48 shows a mill 880 with an interiorly threaded channel 894*a* open at its bottom to the space below the mill 880. A core bore insert 899 with an exteriorly threaded body is removably secured in the channel 894*a*. The core bore insert has a core channel 898 sized in diameter and/or in length for receiving a core of anticipated size from a tubular of known wall thickness and for facilitating separation of said core from said tubular. The core channel 898 extends from a top end of the core bore insert 899 to a bottom end thereof. The channels 898 and 894 are in fluid communication and fluid is initially flowable out from the bottom end of the channel 898. The threading on the insert is preferably configured so that mill rotation does not back out the insert. In addition to or instead of threaded mating, a core bore insert according to this invention may be welded in place and/or held in place with pins or bolts through the mill body and insert body.

The mill 880 in FIG. 49A has a core bore insert 897, like the core bore insert 899, but with a smaller diameter core channel 896. The outer diameter of both core bore inserts 899 and 897 is the same so that either core bore insert is usable in a single mill. It is within the scope of this invention to provide multiple (two, three, four or more) core bore inserts, each having a different diameter and/or a different length to handle anticipated cores of different diameter and/or different length. Such a core bore insert or set of two or more different core inserts may be used with any known mill and with any mill described herein which has a suitable channel or recess for receiving the core bore insert(s).

Matrix milling material and/or inserts 895 (collectively "milling material") may be used in the core bore insert's channel as described above for core bores in other embodiments, on all or part of the channel.

In any core bore insert disclosed herein, the core bore channel may be angled from a longitudinal axis of the core bore insert and/or angled from a longitudinal axis of a mill body of a mill in which the core bore insert is removably or permanently emplaced. Alternatively (or additionally) any channel in a mill into which a core bore insert is emplaced may be at an angle to a longitudinal axis of the mill or in line with said axis. The core bore insert may itself contain a multi-component channel with one part at an angle to another part. Also, the core channel may extend for the full length of the core bore insert and be in fluid communication with another fluid flow channel in a mill, or the core channel of the core bore insert may (like the core channel 674, e.g.) simply terminate at some point within the core bore insert.

The present invention, in certain aspects, provides a milling system for milling an opening through a first portion of a liner in a primary wellbore, the liner having a second portion in communication with the first portion, the second portion of the liner extending into a lateral wellbore in communication with the primary wellbore, the milling system including at least one mill, at least one stabilizing member connected to and above the at least one mill, and the at least one stabilizing member for maintaining position of the at least one mill for milling through the liner into the main wellbore. Such a system may have one, some or all of the following: wherein the milling system includes a tubular to which the at least one mill is connected and wherein the at least one stabilizing member is a plurality of spaced apart stabilizing members on the tubular; wherein the plurality of stabilizing members are formed integrally of the tubular; wherein the at least one stabilizing member has a close fit within the liner; wherein the at least one stabilizing member is exteriorly hardfaced; wherein the liner comprises special drift tubulars; wherein initially prior to commencing milling the liner extends up to a topmost stabilizing member of the plurality of stabilizing members; wherein there is a close fit between exteriors of the plurality of stabilizing members and the interior of the liner that enhances the maintenance of a desired position of the at least one mill for milling the liner; wherein the liner includes a bend portion above the lateral wellbore, wherein the plurality of stabilizing members includes a lowermost stabilizing member above the at least one mill, and the lowermost stabilizing member is spaced apart sufficiently above the at least one mill that the lowermost stabilizing member does not enter the bend portion until milling of the liner by the at least one mill has commenced; wherein the lowermost stabilizing member does not enter the bend portion until the at least one mill has made an initial cut into or cut out in the liner; wherein the at least one mill includes a first mill with an angled cutting portion on a lower end thereof for maintaining desired mill position during milling of the liner; wherein the angled cutting portion comprises crushed carbide secured to the first mill; wherein the angled cutting portion is a concave or conically shaped area at the lower end of the first mill; wherein the at least one mill has a mill body with a body diameter and a lower end cutting structure extending outwardly from the mill body to a lower end diameter, and the lower end diameter is greater than the body diameter; wherein at least one of the at least one stabilizing members is a reaming stabilizer for reaming an opening in the liner made by the at least one mill; wherein the at least one of the stabilizing members is a plurality of reaming stabilizers; wherein the at least one mill is a single mill with a mill body, a plurality of spaced-apart milling blades on the mill body, a fluid flow bore extending through the mill body, and a plurality of spaced-apart fluid exit ports to permit fluid to exit from the mill body, each fluid exit port in fluid communication with the fluid flow bore.

The present invention provides, in certain aspects, a method for milling an opening in a liner, the liner having a first portion in a primary wellbore and a second portion in communication with the first portion and extending into a lateral wellbore extending from and in communication with the primary wellbore, the method including inserting a milling system down the wellbore into the liner, the milling system as any described herein, rotating the milling system by rotating the tubular string to mill the liner, and maintaining with the at least one stabilizing member a desired position of the mill with respect to the liner being milled; and such a method wherein the milling system includes a tubular to which the at least one mill is connected and wherein the at least one stabilizing member is a plurality of spaced apart stabilizing members on the tubular wherein there is a close fit between exteriors of the plurality of stabilizing members and the interior of the liner that enhances the maintenance of a desired position of the at least one mill for milling the liner, wherein the liner includes a bend portion above the lateral wellbore, wherein the plurality of stabilizing members includes a lowermost stabilizing member above the at least one mill, and the lowermost stabilizing member is spaced apart sufficiently above the at least one mill that the lowermost stabilizing member does not enter the bend portion until milling of the liner by the at least one mill has commenced, the method further including positioning the lowermost stabilizing member outside the bend portion until milling of the liner has commenced, and maintaining a desired position of the mill with respect to the liner during milling of the liner.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A method for milling an opening in a liner, the liner having a first portion in a primary wellbore extending down into earth from an earth surface and a second portion in communication with the first portion and extending into a lateral wellbore extending from and in communication with the primary wellbore, the opening for re-establishing communication between an interior of the liner and the primary wellbore, the method comprising inserting a milling system down the wellbore into the liner, the milling system comprising at least one mill, a tubular to which the at least one mill is connected, a plurality of spaced-apart stabilizing members on the tubular and the stabilizing members for maintaining position of the at least one mill for milling through the liner into the main wellbore, the tubular connected to a rotatable tubular string extending up to the earth surface, rotating the milling system by rotating the tubular string to mill the liner, and maintaining with the stabilizing members a desired position of the mill with respect to the liner being milled.

2. The method of claim 1 wherein the plurality of stabilizing members are formed integrally of the tubular.

3. The method of claim 1 wherein the stabilizing members have a close fit within the interior of the liner that enhances the maintenance of a desired position of the at least one mill for milling the liner.

4. The milling system of claim 1 wherein the at least one stabilizing member is exteriorly hardfaced.

5. The milling system of claim 1 wherein the liner comprises special drift tubulars.

6. The milling system of claim 1 wherein initially the liner extends up to a topmost stabilizing member of the plurality of stabilizing members.

7. The milling system of claim 1 wherein the liner includes a bend portion above the lateral wellbore, wherein the plurality of stabilizing members includes a lowermost stabilizing member above the at least one mill, and the lowermost stabilizing member is spaced apart sufficiently above the at least one mill that the lowermost stabilizing member does not enter the bend portion until milling of the liner by the at least one mill has commenced, the method further comprising commencing milling of the liner before the lowermost stabilizing member enters the bend portion of he liner.

8. The milling system of claim 7 wherein the lowermost stabilizing member is located so that it does not enter the bend portion until the at least one mill has made an initial cut out in the liner, the method further comprising milling an initial cut out in the liner before the lowermost stabilizing member enters the bend portion of the liner.

9. The milling system of claim 1 wherein the at least one mill includes a first mill with an angled cutting portion on a lower end thereof for maintaining desired mill position during milling of the liner, the method further comprising maintaining with the first mill desired mill position during milling of the liner.

10. The milling system of claim 9 wherein the angled cutting portion comprises crushed carbide secured to the first mill.

11. The milling system of claim 9 wherein the angled cutting portion is a concave shaped area at the lower end of the first mill.

12. The milling system of claim 1 wherein the at least one mill has a mill body with a body diameter and a lower end cutting structure extending outwardly from the mill body to a lower end diameter, and the lower end diameter is greater than the body diameter.

13. The milling system of claim 1 wherein at least one of the plurality of stabilizing members is a reaming stabilizer for reaming an opening in the liner made by the at least one mill, the method further comprising reaming with the reaming stabilizer an opening in the liner made by the at least one mill.

14. The milling system of claim 13 wherein the at least one of the plurality of stabilizing members is a plurality of reaming stabilizers.

15. The milling system of claim 1 wherein the at least one mill is a single mill with a mill body, a plurality of spaced-apart milling blades on the mill body, a fluid flow bore extending through the mill body, and a plurality of spaced-apart fluid exit ports to permit fluid to exit from the mill body, each fluid exit port in fluid communication with the fluid flow bore, the method further comprising milling the liner with the single mill.

* * * * *